US011925972B2

(12) United States Patent
Wang

(10) Patent No.: US 11,925,972 B2
(45) Date of Patent: Mar. 12, 2024

(54) PRECISION FORGING METHOD, PRECISION FORGING DEVICE, AND PRECISION FORGING PRODUCT

(71) Applicant: National University Corporation Tokai National Higher Education and Research System, Nagoya (JP)

(72) Inventor: Zhigang Wang, Nagoya (JP)

(73) Assignee: National University Corporation Tokai National Higher Education and Research System, Nagoya (JP)

( * ) Notice: Subject to any disclaimer, the term of this patent is extended or adjusted under 35 U.S.C. 154(b) by 357 days.

(21) Appl. No.: 17/273,670

(22) PCT Filed: Apr. 22, 2020

(86) PCT No.: PCT/JP2020/017392

§ 371 (c)(1),
(2) Date: Mar. 4, 2021

(87) PCT Pub. No.: WO2020/218377

PCT Pub. Date: Oct. 29, 2020

(65) Prior Publication Data

US 2021/0339306 A1 Nov. 4, 2021

(30) Foreign Application Priority Data

Apr. 23, 2019 (JP) ..... 2019-082093

(51) Int. Cl.
*B21J 5/06* (2006.01)
*B21J 5/02* (2006.01)
(Continued)

(52) U.S. Cl.
CPC . *B21J 5/06* (2013.01); *B21J 5/02* (2013.01); *B21J 13/02* (2013.01); *B21K 1/30* (2013.01); *B21K 21/02* (2013.01); *B21K 21/08* (2013.01)

(58) Field of Classification Search
CPC ..... B21J 5/02; B21J 5/06; B21J 13/02; B21J 5/12; B21J 9/02; B21K 21/08; B21K 1/30; B21K 21/02
(Continued)

(56) References Cited

U.S. PATENT DOCUMENTS 7,673,376 B2 * 3/2010 Frauchiger ..... B21K 1/30 29/33 R
9,017,491 B2 4/2015 Oishi et al.
(Continued)

FOREIGN PATENT DOCUMENTS

JP S56141935 11/1981
JP S61255740 A 11/1986
(Continued)

OTHER PUBLICATIONS

"European Application Serial No. 20796108.7, Extended European Search Report dated Dec. 21, 2022", 7 pgs.
(Continued)

*Primary Examiner* — Adam J Eiseman
*Assistant Examiner* — Jared O Brown
(74) *Attorney, Agent, or Firm* — Schwegman Lundberg & Woessner, P.A.

(57) ABSTRACT

A precision forging method includes arranging a metal material in a die cavity so that a distal end surface of a wall portion of the metal material is opposed toward a stopper and a bottom portion of the metal material is opposed toward a punch. Further, the precision forging method includes moving the punch, which includes a cutting blade on an edge of a working end surface, in the die cavity to cut part of the wall portion thickness-wise with the cutting blade and cause shear deformation in the cut portion.

8 Claims, 20 Drawing Sheets

(51) Int. Cl.

| | |
|---|---|
| ***B21J 13/02*** | (2006.01) |
| ***B21K 1/30*** | (2006.01) |
| ***B21K 21/02*** | (2006.01) |
| ***B21K 21/08*** | (2006.01) |

(58) Field of Classification Search
USPC ..... 72/353.2, 354.2, 355.2
See application file for complete search history.

(56) References Cited

U.S. PATENT DOCUMENTS

| | | | | |
|---|---|---|---|---|
| 2018/0104735 | A1 | 4/2018 | Yoshikawa et al. | |
| 2018/0200773 | A1* | 7/2018 | Nishijima | B21J 5/02 |

FOREIGN PATENT DOCUMENTS

| | | | | | |
|---|---|---|---|---|---|
| JP | H0455034 | A | | 2/1992 | |
| JP | H0538546 | A | | 2/1993 | |
| JP | 2001047173 | | | 2/2001 | |
| JP | 2015074018 | A | * | 4/2015 | B21J 13/02 |
| KR | 20170108486 | A1 | * | 9/2017 | |
| WO | WO-2014148357 | A1 | * | 9/2014 | B21J 13/02 |
| WO | 2016175281 | | | 11/2016 | |
| WO | 2020204129 | | | 10/2020 | |

OTHER PUBLICATIONS

Wang, Zhi Gang, et al., "A new forming method of flange on a drawn cup by plate forging", 17th International Conference on Metal Forming, Metal Forming 2018, Sep. 16-19, 2018, Toyohashi, Japan, In: Procedia Manufacturing, 15, (2018), 955-960.

"International Application Serial No. PCT/JP2020/017392, International Search Report dated Jul. 28, 2020", w/ English Translation, 5 pgs.

"European Application Serial No. 20796108.7, Communication pursuant to Article 94(3) dated Sep. 4, 2023", 5 pgs.

* cited by examiner $r_{cp}=2$
40
14
22
20
32
(A)
30
31
10
12A
12B
B
a
0mm
1mm
3mm
6mm
Stroke of Punch 30

PRECISION FORGING METHOD, PRECISION FORGING DEVICE, AND PRECISION FORGING PRODUCT

This application is a U.S. National Stage Filing under 35 U.S.C. 371 from International Application No. PCT/JP2020/017392, filed on Apr. 22, 2020, and published as WO 2020/218377 A1 on Oct. 29, 2020, which claims the benefit of priority under 35 U.S.C. § 119 to Japanese Patent Application No. 2019-082093, filed on Apr. 23, 2019, each of which is incorporated by reference herein in its entirety.

TECHNICAL FIELD

The present disclosure relates to a precision forging method, a precision forging device, and a precision forging product.

BACKGROUND ART

Precision forging, which is cold forging, allows high precision components to be manufactured at low costs and is thus widely used to manufacture small precision components for automobiles and electric/electronic devices (refer to patent document 1 and patent document 2). Precision forging combines the basic working processes of upsetting and extrusion to perform shaping. In a final stage of the shaping process, an enormous amount of tool pressure is required to force the workpiece into a non-filled portion of a die.

PRIOR ART DOCUMENT

Patent Document

Patent Document 1: Japanese Laid-Open Patent Publication No. 4-5503; Patent Document 2: Japanese Laid-Open Patent Publication No. 61-255740.

Non-Patent Document 1: Zhi Gang Wang, Wen Zheng Dong, Hiroyasu Yatou, A new forming method of flange on a drawn cup by plate forging", Procedure Manufacturing 15 (2018) 955-960, [online], "17th International Conference on Metal Forming", Metal Forming 2018, 16-19 September, Toyohashi, Japan [Searched on March 24,2020], Internet <https://www.sciencedirect.com/journal/procediamanufacturing/vol/15/suppl/C?page=2>.

SUMMARY OF THE INVENTION

Problems That the Invention is to Solve

With the present technology, there is a need for the tool pressure to be at least three times or greater than the tensile strength of the workpiece even when working conditions, such as the material flow and lubrication of the workpiece, are optimized. Thus, due to the withstanding pressure limits of the tool material, high-strength material and large-dimension components are not subject to precision forging.

FIG. 6 of Non-Patent Document 1 shows the shaping of an outwardly directed flange of a drawn cup. In this example, the outer side of a circumferential wall of the drawn cup is shaved with a punch so that the shaved metal portion becomes the outwardly directed flange. The outwardly directed flange is, however, deformed to extend in the radial direction about the axis of the cup during shaping into free space without any constraint. Thus, the material may crack at the portion of the circumferential wall opposed toward the blade end of the punch. FIG. 23 of the present disclosure shows a cut cross section of a portion connecting the outwardly directed flange and the circumferential wall of the cup when the shaved drawn cup is cut in the axial direction. FIG. 24 shows the enlarged cross section of the portion inside the square frame in FIG. 23. As shown in the two drawings, the material is cracked in the portion connecting the outwardly directed flange and the circumferential wall.

One object of the present disclosure is to provide a precision forging method, a precision forging device, and a precision forging product that avoid cracking and do not require a massive tool pressure during precision forging.

Means for Solving the Problem

A precision forging method in accordance with the present disclosure includes arranging a metal material including a wall portion, which extends in a moving direction of a punch, and a pre-working projecting wall, which extends from the wall in a direction intersecting the moving direction, in a die cavity of a die, and moving the punch to forge the metal material.

The precision forging method includes a first step of arranging the punch, which includes a working end surface and a cutting blade formed at an edge of the working end surface, in the die cavity so that the punch is opposed toward part of the wall portion thickness-wise and the pre-working projecting wall of the metal material.

Further, the precision forging method includes a second step of moving the punch within a range of a height of the wall portion in a state in which the metal material is held in the moving direction of the punch and a length of the pre-working projecting wall in the intersecting direction is maintained so that the cutting blade cuts the part of the wall portion thickness-wise located in a moving path of the punch and causes shear deformation in the cut part to move the cut part toward the pre-working projecting wall.

The method may further include arranging the metal material, which includes a fit region where at least part of the wall portion comes into plane contact with a wall surface of the die cavity and the pre-working projecting wall located at a side opposite to the fit region, in the die cavity, and arranging the cutting blade of the punch spaced apart from the wall surface of the die cavity by a distance smaller than a thickness of the wall portion. The second step may include cutting the metal material with the cutting blade so that the fit region remains in the wall portion.

Further, the first step may include arranging the metal material in the die cavity so that the wall portion is spaced apart from a wall surface of the die cavity and at least part of the pre-working projecting wall comes into plane contact with the wall surface of the die cavity. The cutting blade is formed inward from a side of the plane contact.

In the precision forging method, the punch is a first punch, and the first step may include arranging a second punch at a side of the pre-working projecting wall opposite to the first punch. Further, the second step may include moving the second punch so as to follow movement of the first punch in the moving direction.

In the precision forming method, when the wall portion is a circumferential wall and an amount of the circumferential wall cut by the punch is expressed by $t_0$, a length of the punch in the intersecting direction is greater by $2t_0$ mm than an inner diameter of the circumferential wall. The pre-working projecting wall may have a thickness $t_{c0}$ that satisfies 0.1 mm$\leq t_{c0} \leq$20 mm. In a joint line between the circumferential wall and the pre-working projecting wall, the joint line located at a side of the pre-working projecting wall opposite to the punch has a radius of curvature expressed by $r_{cp}$ that satisfies $r_{cp}/t_{c0}<2.0$. The metal material may be worked so that $t_0/t_{c0}$ satisfies in equation (1), which is as follows:

$$t_0/t_{c0} \geq 0.052 r_{cp}/t_{c0} + 0.23 \quad (1).$$

In the precision forming method, when the wall portion is a circumferential wall and an amount of the circumferential wall cut by the punch is expressed by $t_0$, a length of the punch in the intersecting direction is greater by $2t_0$ mm than an inner diameter of the circumferential wall. The pre-working projecting wall may have a thickness $t_{c0}$ that satisfies 0.1 mm$\leq t_{c0} \leq$20 mm. In a joint line between the circumferential wall and the pre-working projecting wall, the joint line located at a side of the pre-working projecting wall opposite to the punch has a radius of curvature expressed by $r_{cp}$ that satisfies $r_{cp}/t_{c0} \geq 2.0$. The metal material may be worked so that $t_0/t_{c0}$ satisfies in equation (2), which is as follows:

$$t_0/t_{c0} \geq 3.0 r_{cp}/t_{c0} - 5.7 \quad (2).$$

In the precision forging method, the second step may include having the stopper come into contact with a distal end surface of the wall portion to hold the metal material in the moving direction of the punch.

A precision forging device in accordance with the present disclosure is for forging a metal material. The precision forging device includes a die, including a die cavity configured to allow for arrangement of the metal material, and a punch configured to move in the die cavity to forge the metal material. The metal material includes a wall portion, which extends in a moving direction of the punch, and a pre-working projecting wall, which extends from the wall portion in a direction intersecting the moving direction. The punch is opposed toward part of the wall portion thickness-wise and the pre-working projecting wall when the metal material is arranged in the die cavity. The punch includes a working end surface and a cutting blade, which is formed on an edge of the working edge surface. When the punch is moved within a range of a height of the wall portion, the cutting blade is configured to cut part of the wall portion thickness-wise in a moving path of the punch and cause shear deformation in the cut part.

Further, the precision forging device may include a stopper configured to come into contact with a distal end surface of the wall portion when the punch moves, thereby holding the metal material in the moving direction of the punch.

A precision forging product in accordance with the present disclosure includes a wall portion extending in a first direction and a post-working projecting wall extending from the wall portion in a second direction that intersects the first direction. The post-working projecting wall includes a first surface, which is at a side where a joint line (A) between the wall portion and the post-working projecting wall is located, and a second surface, which is at a side opposite to the first surface. The precision forging product further includes a metal flow (W) extending from the joint line (A) to a joint line (B) in the second surface.

In the precision forging product, the wall portion may be a circumferential wall extending circumferentially, and the post-working projecting may be an inwardly directed flange or a bottom portion formed on an inner surface of the circumferential wall or an outwardly directed flange formed on an outer surface of the circumferential wall.

In the precision forging product, the wall portion may have the form of a flat plate or be curved or bent as viewed in a transverse cross section that is orthogonal to the first direction.

Effects of the Invention

One object of the present disclosure is to provide a precision forging method, a precision forging device, and a precision forging product that avoid cracking and do not require a massive tool pressure during precision forging.

MODES FOR CARRYING OUT THE INVENTION

A precision forging method, a precision forging device, and a precision forging product in accordance with a first embodiment will now be described with reference to FIGS. 1 and 2. A metal material 10 used in the present embodiment will now be described.

<Metal Material 10>

Figure 1A:
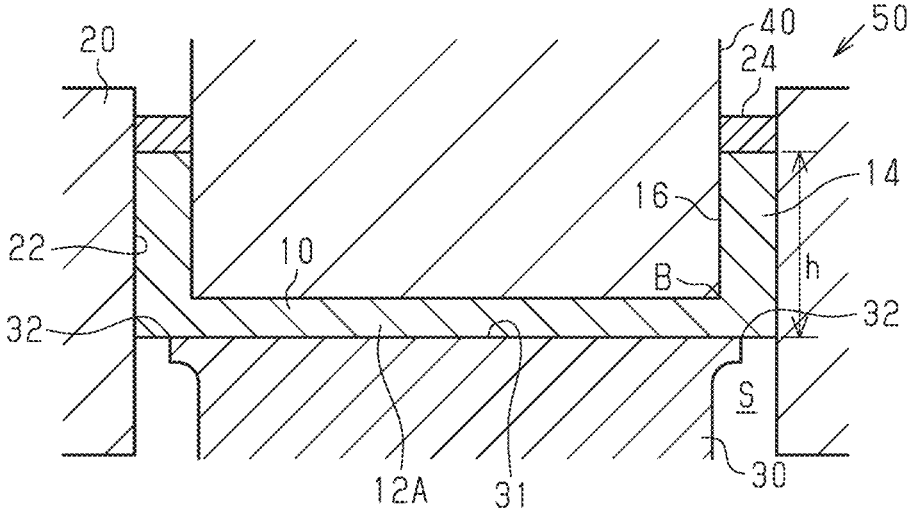
FIGS. 1A, 1B, and 1C are diagrams illustrating steps of a precision forging method in accordance with a first embodiment.

Referring to FIG. 1A, the metal material 10 is not limited and may be any material that can be used for plastic working. Examples of thin metal sheets used for plastic working include cold-roll high tensile steel plates (SPFC, SPFCY, SPFH, SPFHY), cold roll steel plates (SPCC, SPCCT, SPCD, SOCE, SPCEN), SPP, and the like. Further, stainless steels used for plastic working include SUS201, SUS304, SUS316, SUS321, SUS440, SUS450, and the like. Aluminum alloy expanded materials used for plating working include A3003, A3004, A5005, A2014, A2017, A2024, and the like. Metal materials used for plastic working also include alloy steel such as SCr (chrome steel), SCM (chrome molybdenum steel), SNCM (nickel chrome molybdenum steel), and the like.

As shown in FIG. 1A, the metal material 10 used in a first step, which will be described later, is shaped to include a circumferential wall 14, which serves as a wall portion and extends circumferentially, and a bottom portion 12A, which is integrally coupled to the circumferential wall 14 at one end of the circumferential wall 14. There is no limitation to how to obtain such a shape. For example, drawing or cutting may be performed for shaping. The circumferential wall 14 extends in a first direction that is an axial direction. The bottom portion 12A extends from the circumferential wall 14 in a direction intersecting (more specifically, direction orthogonal to) the axial direction, that is, in the radial direction and has the form of a flat plate. The bottom portion is denoted by reference character "12A" prior to precision forging, or prior to working, and denoted by reference character "12B" during and subsequent to precision forging. The bottom portion 12A corresponds to a pre-working projecting wall. The bottom portion 12B corresponds to a post-working projecting wall.

The circumferential wall 14 surrounds an open space 16 and is shaped to have a horizontal cross section in the form of a circle, an ellipsis, a gear, a quadrangle, or the like. However, there is no limitation to the shape.

<Precision Forging Device>

A precision forging device 50 used in the present embodiment will now be described.

As shown in FIGS. 1A to 1C, and 2A, the precision forging device 50 includes a die 20, a punch 30, a stopper 24, and a counter punch 40. For the sake of brevity, FIGS. 1A to 1C, 2A, and 4A to 4F show the punch 30, the counter punch 40, the stopper 24, and the die 20 reversed so as to be upside down. Thus, the punch 30 is moved during forging from the lower side toward the upper side as viewed in the drawings. More specifically, in the actual precision forging device 50, the punch 30 is located at the upper side. The counter punch 40 is located at the lower side, and is moved during forging to allow the punch 30 to move from the upper side toward the lower side. An air cylinder or the like (not shown) applies back pressure to the counter punch 40. In embodiments from a second embodiment that are described below, the punch 30, the counter punch 40, the die 20, and the like are shown in the drawings reversed upside down. Thus, the punch 30 is moved during forging from the lower side toward the upper side as viewed in the drawings.

The die 20 includes a die cavity 22. The die cavity 22 is shaped to have a horizontal cross section in the form of circle in the present embodiment. However, there is no limitation to the shape as long as it conforms to the contour shape of the circumferential wall 14. The stopper 24 is fixed horizontally to the wall surface of the die cavity 22. Preferably, the outer circumference of the stopper 24 has the same shape as the horizontal cross section of the die cavity 22 so that it conforms to the horizontal cross section of the die cavity 22. Accordingly, in the present embodiment, the outer circumference of the stopper 24 is shaped as a circular ring in correspondence with the outer shape of the metal material 10.

When the horizontal cross section of the die cavity 22 has a shape other than the form of a circle, the stopper 24 is shaped as a non-circular ring in conformance with the shape of the horizontal cross section of the die cavity 22. For example, the horizontal cross section of the die cavity 22 may have the form of a polygon, such as a triangle, a quadrangle, or a pentagon, or the form of an ellipsis, and the contour of the stopper 24 may have a conforming shape.

The stopper 24 may have the same thickness in the radial direction as the circumferential wall 14 to contact the entire end surface of the circumferential wall 14 of the metal material 10. The stopper 24 may be an engagement step formed integrally with the die 20.

As shown in FIGS. 1A to 1C and FIG. 2A, the punch 30 includes a working end surface 31 that is flat. A cutting blade 32 that is circular in a plan view is formed along the entire circumference of the working end surface. The cutting blade 32 is opposed toward and spaced apart from the wall surface of the die cavity 22 in the radial direction. More specifically, the cutting blade 32 is arranged so as to be spaced apart by a gap S from the wall surface of the die cavity 22. The cutting blade 32 is formed to move continuous chips, which are produced when the bottom portion 12A (12B) of the metal material 10 is cut, toward the central portion (axis) of the punch 30.

The punch 30 has a diameter that is smaller than the inner diameter of the die cavity 22 and is arranged coaxially with the die cavity 22. The punch 30 is moved in the die cavity 22 so that the circumference of the bottom portion 12A (12B) of the metal material 10, that is, the portion located radially outward from the cutting blade 32, remains in the gap S between the punch 30 and the wall surface of the die cavity 22.

The counter punch 40, which is opposed toward the punch 30, is arranged in the open space surrounded by the circumferential wall 14 and the bottom portion 12A (12B) of the metal material 10 so as to contact the inner bottom surface of the bottom portion 12A (12B). An air cylinder or the like (not shown) applies back pressure to the counter punch 40 so that the inner bottom surface of the bottom portion 12A (12B) is constantly pressed. The punch 30 corresponds to a first punch, and the counter punch 40 corresponds to a second punch. The counter punch 40 is not an essential element and may be omitted.

A precision forging method in accordance with the present embodiment will now be described. In the present embodiment, precision forging may also be referred to as cut forging.

<Precision Forging Method>

The precision forging method will now be described with reference to FIGS. 1A to 1C, 2A, 3A, 3B, 4A to 4F, 5, 6A to 6D, and 7.

First Step

As shown in FIG. 1A, in a first step, the metal material 10, which includes the bottom portion 12A and the circumferential wall 14, is arranged in the die cavity 22 of the die 20 of the precision forging device 50 so that the distal end surface of the circumferential wall 14 comes into contact with the stopper 24. In this state, the circumferential wall 14 extends in the direction in which the punch 30 is moved in the die cavity 22, and the bottom portion 12A extends in a direction intersecting the moving direction. The moving direction of the punch 30 coincides with the axial direction of the circumferential wall 14. Further, the outer circumferential surface of the circumferential wall 14 is in a state in plane contact with the wall surface of the die cavity 22. The plane contact region of the outer circumferential surface of the circumferential wall 14 corresponds to a fit region. In the present embodiment, the entire outer circumferential surface of the circumferential wall 14 is referred to as the fit region that is in plane contact with the wall surface of the die cavity 22. However, the fit region does not have to be the entire outer circumferential surface of the circumferential wall 14. Part of the outer circumferential surface of the circumferential wall 14 in the axial direction may be in plane contact with the wall surface of the die cavity 22, and this part may be referred to as the fit region. The bottom portion 12A extends from the circumferential wall 14 away from the fit region of the circumferential wall 14. The radial direction of the circumferential wall 14 coincides with a thickness-wise direction of the circumferential wall 14. The punch 30 is arranged in the die cavity 22 and opposed in the axial direction of the circumferential wall 14 toward the bottom portion 12A and part of the circumferential wall 14 thickness-wise. The part of the circumferential wall 14 thickness-wise opposed toward the punch 30 is a region of the circumferential wall 14 located inward from the outer edge of the cutting blade 32. In the present embodiment, the punch 30 is opposed toward part of the circumferential wall 14 thickness-wise. However, depending on the position where the cutting blade 32 is arranged, the punch 30 may be opposed to the entire circumferential wall 14 thickness-wise.

Second Step

In a second step, the punch 30 is moved toward and pushed against the bottom portion 12A as the cutting blade 32 cuts the bottom portion 12A (refer to FIGS. 1B, 1C, and 4A to 4F). In this state, the metal material 10 is held by the stopper 24 in the moving direction of the punch 30. The movement amount of the punch 30 from where the punch 30 initially comes into contact with the bottom portion 12A is in a range that is greater than or equal to the thickness of the bottom portion 12A and less than the height h of the circumferential wall 14 (refer to FIG. 1A).

Figure 2A:
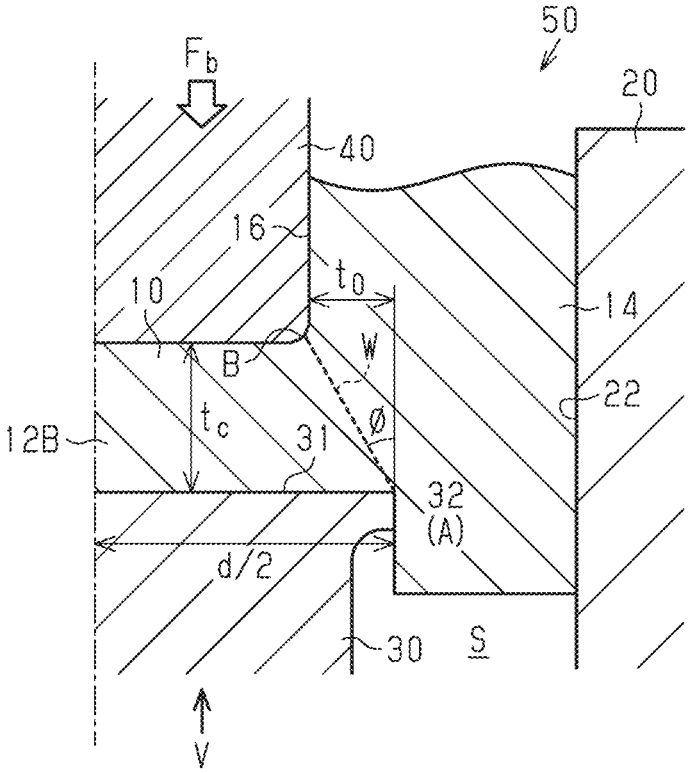
FIG. 2A is a diagram illustrating the principle of cut forging.

When the punch 30 pushes the bottom portion 12A and cuts part of the circumferential wall 14 thickness-wise with the cutting blade 32, a joint line A is formed in the bottom portion 12A (12B) that comes into contact with the cutting blade 32, as shown in FIG. 2A. As shown in FIG. 2A, the joint line A is continuously formed at where the remaining part of the circumferential wall 14 that was not cut by the cutting blade 32 joins the bottom portion 12A (12B). In the present embodiment, the joint line A is formed to extend in the circumferential direction of the circumferential wall 14. The cutting blade 32 causes shear deformation between the joint line A and the inner surface edge of the bottom portion 12A (12B). The inner surface edge of the bottom portion 12A (12B) defines a joint line B between the bottom portion 12B and the circumferential wall 14. The joint line B in the present embodiment is formed continuously in the circumferential direction in the corner located at the side of the bottom portion 12A (12B) opposite to the punch 30. The sheared material (chips) cut out by the cutting blade 32 enters the bottom portion 12A (12B) between the punch 30 and the counter punch 40 (i.e., node) and forms a metal flow W between the joint line A and the joint line B, which are shown in FIG. 2A. Hereinafter, the part of the bottom portion 12B subsequent to cut forging that corresponds to the joint line A is referred to as the edge A.

Further, the inner surface of the bottom portion 12B at the side where the joint line B is located, or the inner bottom surface, corresponds to a second surface, and the surface of the bottom portion 12B at the side opposite to the inner bottom surface, or the outer bottom surface, corresponds to a first surface. The metal flow W extends from the joint line A of the first surface (outer bottom surface) to the second surface (inner bottom surface).

Figure 1B:
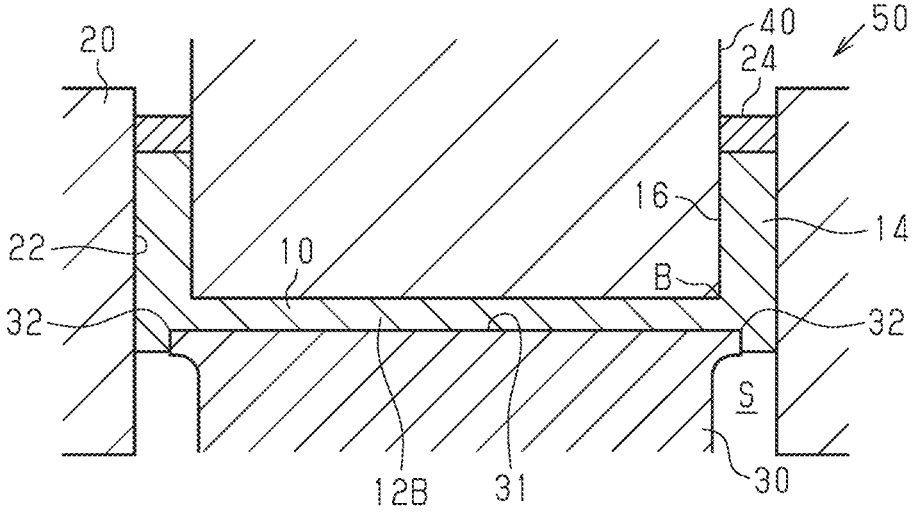
Figure 1C:
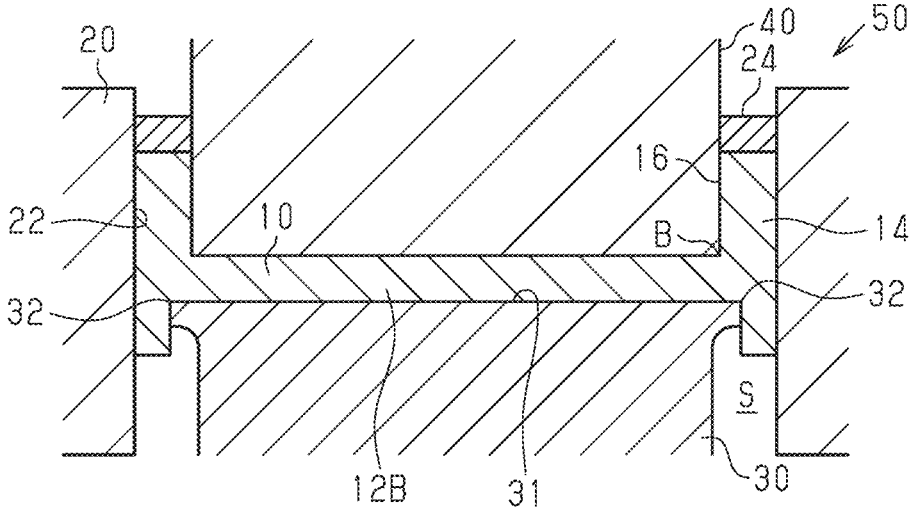

The bottom portion 12A, 12B is constrained by the die 20 so that the dimensions do not change in a direction intersecting the moving direction of the punch 30, as shown in FIGS. 1A to 1C. Thus, as the working performed by the punch 30 progresses, the material (chips) is compressed and moved toward the node to increase the thickness of the node.

The flow of the metal material 10 in this state will be described in detail later.

The back pressure $F_b$ applied to the counter punch 40 is much smaller than the pushing force F of the punch 30, that is, $F_b \ll F$ is satisfied. As the thickness of the node increases as described above, the counter punch 40 is moved backward against the urging force (back pressure) applied by the air cylinder or the like (not shown).

Further, as shown in FIGS. 1C and 2A, when the punch 30 pushes and moves the bottom portion 12A (12B), the portion of the circumferential wall 14 located radially outward from the cutting blade 32, namely, the fit region that is in plane contact with the wall surface of the die cavity 22 remains in a non-worked state as if to partially fill the gap S between the die 20 and the punch 30. The fit region of the circumferential wall 14 is tubular. This obtains a precision forging product including a circumferential wall on both sides of the bottom portion 12B, that is, a precision forging product having an H-shaped vertical cross section.

The pushing force p per unit area of the punch 30 required for working is estimated from the energy U required for working as shown below.

$$p/2k=4t_c(\tan\varphi+0.5\cos^{-2}\varphi)/d(1-\mu\tan\varphi)=4t_c/df(\varphi) \quad (3)$$

(2 k: deformation resistance of metal material, $t_c$: node thickness, φ: shearing angle, d: diameter of punch 30, μ: friction coefficient)

Here, f(φ) is expressed by the equation shown below.

$$f(\varphi)=(\tan\varphi+0.5\cos^{-2}\varphi)/(1-\mu\tan\varphi) \quad (4)$$

<Derivation of Equation (3)>

The derivation of equation (3) will now be described.

As shown in FIG. 2A, when the length of the punch 30 extending radially outward from the inner surface of the circumferential wall 14 is expressed by $t_0$, the cutting ratio r is as shown below.

$$r=t_0/t_c=\tan\varphi \quad (5)$$

Here, $t_0$ is the difference between the radius of the inner surface of the circumferential wall 14 and the radius of the punch 30. This is the amount of the circumferential wall 14 cut by the punch 30 in the radial direction.

Based on conservation of mass of the sheared material, the speed $V_e$ at which chips in the shear region moves in the radial direction of the punch 30 is shown below.

$$V_c=V\cdot r=V\cdot\tan\varphi \quad (6)$$

Figure 2B:
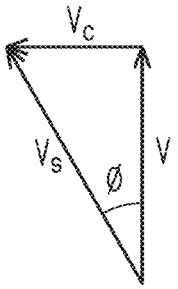
FIG. 2B is a diagram illustrating the relationship of the shearing speed $V_s$ the punch speed V, and the chip speed $V_c$ in the radial direction in the vicinity of a shear region.

Here, V is the speed of the punch 30. The shearing speed $V_S$ when undergoing vector decomposition is $V_s=V/\cos\varphi$ as shown in FIG. 2B. The total energy U input by the punch 30 during working is U=F·V.

Here, F represents the pressing force of the punch 30. The energy $E_s$ required during shearing at the shear region can be estimated from the equation shown below.

$$E_s=\pi\cdot d(t_0^2+t_c^2)^{1/2}V_s\cdot k \quad (7)$$

Here, k represents the shearing resistance (deformation resistance) of the metal material, and d represents the diameter of the punch 30. The energy $E_c$ required for compressing the chips in the radial direction may be calculated as shown below.

$$E_c=2\pi\cdot d\cdot t_c\cdot k\cdot V_c \quad (8)$$

The energy $E_f$ dissipated by friction between the chips and the punch 30 is calculated from the equation shown below.

$$E_i=\mu\cdot F\cdot V_c \quad (9)$$

Here, μ represents the friction coefficient between the chips and the punch 30. The back pressure (urging force) of the counter punch 40 is expressed by $F_b$, and the energy of the back pressure is expressed by $E_b$.

$$E_b=F_b\cdot V \quad (10)$$

$$U=E_s+E_c+E_f+E_b \quad (11)$$

Thus, the pushing force F of the punch 30 is expressed by the equation shown below.

$$F=2\pi\cdot d\cdot t_c\cdot k(\tan\varphi+0.5\cos^{-2}\varphi)/(1-\mu\tan\varphi) \quad (12)$$

Here, $F_b \ll F$ is satisfied. Thus, when $F_b$ is a small value that can be ignored, the average pushing force p·of the punch 30 (per unit area) is as shown in equation (3).

In this case, tan φ is in the range from 0.1 to 1.0 and μ is in the range from 0.1 to 0.3. This satisfies p/2 k=3$t_c$/d to 12$t_c$/d.

Here, $t_c$/d is in the range from 0.01 to 0.1. Thus, p/2 k is less than 1 and much smaller than conventional cold forging.

<Flow of Metal Material 10>

The flow of the metal material 10 that occurs during the cut forging of the second step was simulated and checked. The simulation software that was used is commercial finite element code DEFORM2D. The simulation conditions are as shown in table 1.

TABLE 1

Simulation Conditions

| Parameter | Unit | Value |
|---|---|---|
| Flow Stress of Worked Material | Mpa | $\sigma = C\varepsilon^{\pi}$ |
| Plasticity Coefficient of Worked Material, C | Mpa | 501 |
| Work-Hardening Coefficient, n | | 0.24 |
| Worked Material Inner Diameter, $d_w$ | mm | 60 |
| Worked Material Circumferential Wall Thickness, $t_w$ | mm | 2 |
| Worked Material Bottom Portion Thickness, $t_{c0}$ | mm | 2 |
| Worked Material Corner Radius, $r_c$ | mm | 0.1-3.5 |
| Punch Diameter, d | mm | 60-64 |
| Punch Shoulder Radius, $r_p$ | mm | 0.1 |
| Punch Speed, V | mm/s | 10 |
| Counter Punch Diameter $d_{cp}$ | mm | 60 |
| Counter Punch Shoulder Radius, $r_{cp}$ | mm | 0.1-3.5 |
| Counter Punch Back Pressure, Pb/C | | 0.005-0.05 |
| Friction Coefficient with Die, $\mu_d$ | | 0.1 |

TABLE 1-continued

| Simulation Conditions | | |
|---|---|---|
| Parameter | Unit | Value |
| Friction Coefficient with Counter Punch, $\mu_{cp}$ | | 0.1 |
| Friction Coefficient with Punch, $\mu_p$ | | 0.1-0.5 |

Figure 3A:
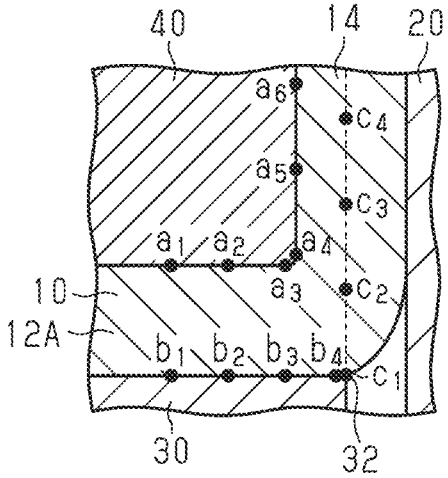
FIG. 3A is a cross-sectional view showing the main part of a metal material prior to cut forging.

FIG. 3A is a cross-sectional view of the metal material 10 prior to cut forging. As shown in the drawing, points a1 to a3 are marked on the upper surface (inner surface) of the bottom portion 12A, points a4 to a6 are marked on the inner surface of the circumferential wall 14, points b1 to b4 are marked on the lower surface (outer surface) of the bottom portion 12A, and points c1 to c4 are marked in the moving path of the cutting blade 32 of the punch 30.

Figure 3B:
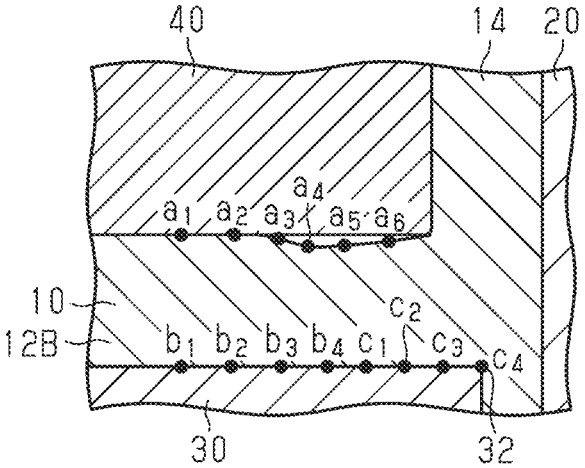
FIG. 3B is a cross-sectional view showing the main part of the metal material subsequent to cut forging.

FIG. 3B is a cross-sectional view obtained through the simulation of the metal material 10 subsequent to completion of the cut forging performed by the punch 30. As shown in the drawing, points a1 to a3 and b1 to b on the bottom portion 12B are moved toward the central part of the bottom portion 12B in the radial direction. Further, the points a4 to a6 on the inner surface of the circumferential wall 14 are moved to the upper surface of the bottom portion 12B.

Additionally, points c1 to c4 in the moving path of the cutting blade 32 shown in FIG. 3A are all moved to the lower surface of the bottom portion 12B. It is considered that working hardening occurring during cut forging improves the product strength such as pressure resistance at the bottom portion 12B.

Figure 5:
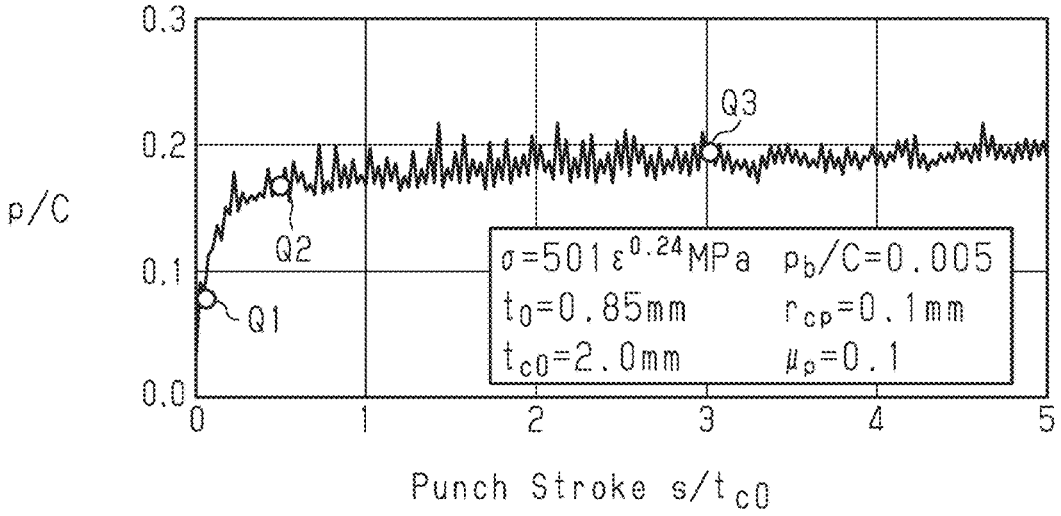
FIG. 5 is a characteristics diagram illustrating p/C with respect to punch stroke.

FIG. 5 is a characteristics diagram of p(pressure)/C with respect to the stroke of the punch 30 in one example of the simulation.

Figure 4A:
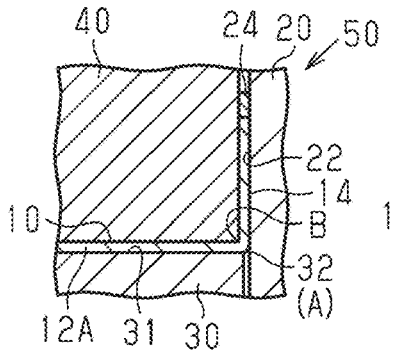
FIG. 4A is a cross-sectional view showing the vicinity of a corner of a punch when cut forging is started.
Figure 4C:
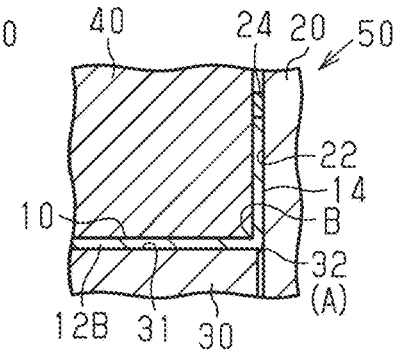
FIG. 4C is a cross-sectional view showing the vicinity of the corner of the punch in a stage subsequent to FIG. 4A.
Figure 4E:
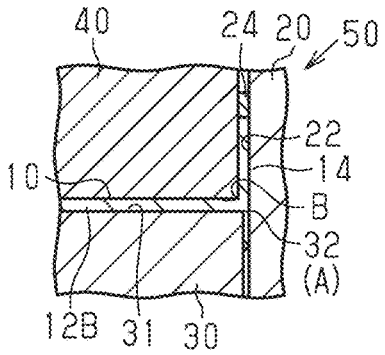
FIG. 4E is a cross-sectional view showing the vicinity of the corner of the punch in a stage subsequent to FIG. 4C.
Figure 4B:
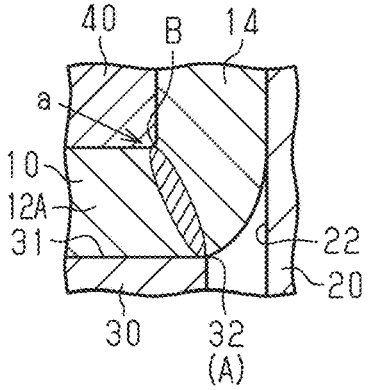
FIG. 4B is an enlarged cross-sectional view of FIG. 4A.
Figure 4D:
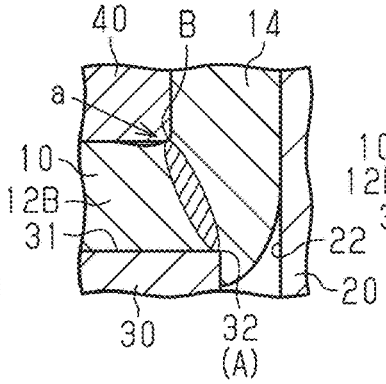
FIG. 4D is an enlarged cross-sectional view of FIG. 4C.
Figure 4F:
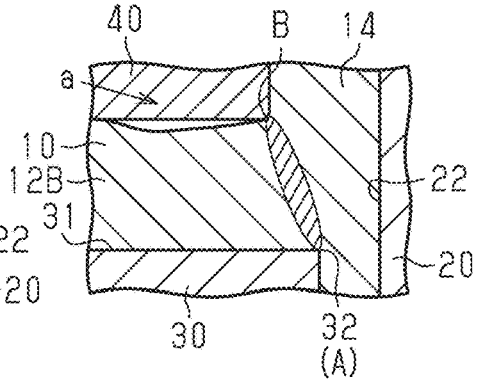
FIG. 4F is an enlarged cross-sectional view of FIG. 4E.

In FIG. 5, points Q1 to Q3 respectively correspond to the stages shown in FIGS. 4B, 4D, and 4F. FIG. 4A is a cross-sectional view showing the vicinity of a punch corner in an initial stage of cut forging, and FIG. 4B is an enlarged cross-sectional view of FIG. 4A. FIG. 4C is a cross-sectional view showing the vicinity of the punch corner in a stage subsequent to FIG. 4A, and FIG. 4D is an enlarged cross-sectional view of FIG. 4C. FIG. 4E is a cross-sectional view showing the vicinity of the punch corner in a stage subsequent to FIG. 4C, and FIG. 4F is an enlarged cross-sectional view of FIG. 4E. In FIGS. 4B, 4D, and 4F, the region between the bottom portion 12A (12B) and the circumferential wall 14 connecting the edges A and B in the upper and lower surfaces of the bottom portion 12B is a region where shearing stress concentrates during cut forging. The region where stress concentrates is indicated by hatching lines extending in a direction that differs from the hatching lines of the other part of the bottom portion 12A (12B) and the circumferential wall 14. In the same manner, FIGS. 6B to 6D, which will be referred to later, also indicate the region where stress concentrates using hatching lines extending in a direction that differs from the hatching lines of other parts.

As shown in FIGS. 4A to 4F, the punch 30 comes into contact with the bottom portion 12A and then moves over a distance that is greater than or equal to the thickness of the bottom portion 12A. The movement of the punch 30 and the shear deformation between the punch 30 and the counter punch 40 resulting from the movement moves the bottom portion 12B in the same direction as the punch 30. The bottom portion 12B is kept substantially flat and local bulges do not form under the simulation condition. A recess, slightly recessed and including a gradually recessed surface, is formed in the upper surface (inner surface) of the bottom portion 12B near the corner of the counter punch 40. More specifically, the thickness of the bottom portion 12B slightly decreases near the corner of the counter punch 40. The recess including the gradually recessed surface formed in the upper surface of the bottom portion 12B is enlarged toward the center of the bottom portion 12B in the radial direction as the stroke of the punch 30 increases.

As shown in FIG. 5, as the stroke (movement amount) of the punch 30 increases from point Q1, the pressure of the punch 30 suddenly increases. The pressure of the punch 30 gradually increases from point Q2 at which the edge (cutting blade 32) of the punch 30 reaches the shearing region. The pressure of the punch 30 stabilizes in the shearing region that includes point Q3.

Although not shown in the drawings, in simulations in which the back pressure of the counter punch 40 was changed a number of times, changes were subtle in the shape of the observed product.

<Recess Including Gradually Recessed Surface and Sink>

A case where a recess including a gradually recessed surface was formed and a case where a recess having an acute shape (hereafter referred to as sink) was formed were observed in simulations. A recess, which has a gradually recessed surface, and a sink have a relationship with the radius of curvature at the joint line B in the inner surface of the bottom portion 12A opposed toward the corner of the counter punch 40. The radius of curvature at the joint line B in the inner surface of the bottom portion 12A may hereafter be referred to as the shoulder radius. When the shoulder radius is large, in an initial cutting state, the metal material will be insufficient at the joint line B in the inner surface of the bottom portion 12A.

When a recess including a gradually recessed surface is formed, stress is initially concentrated at point a. As shear deformation progresses as shown in FIGS. 4D and 4F, the recess including the gradually recessed surface is enlarged.

Figures 6A, 6B, 6C, 6D:
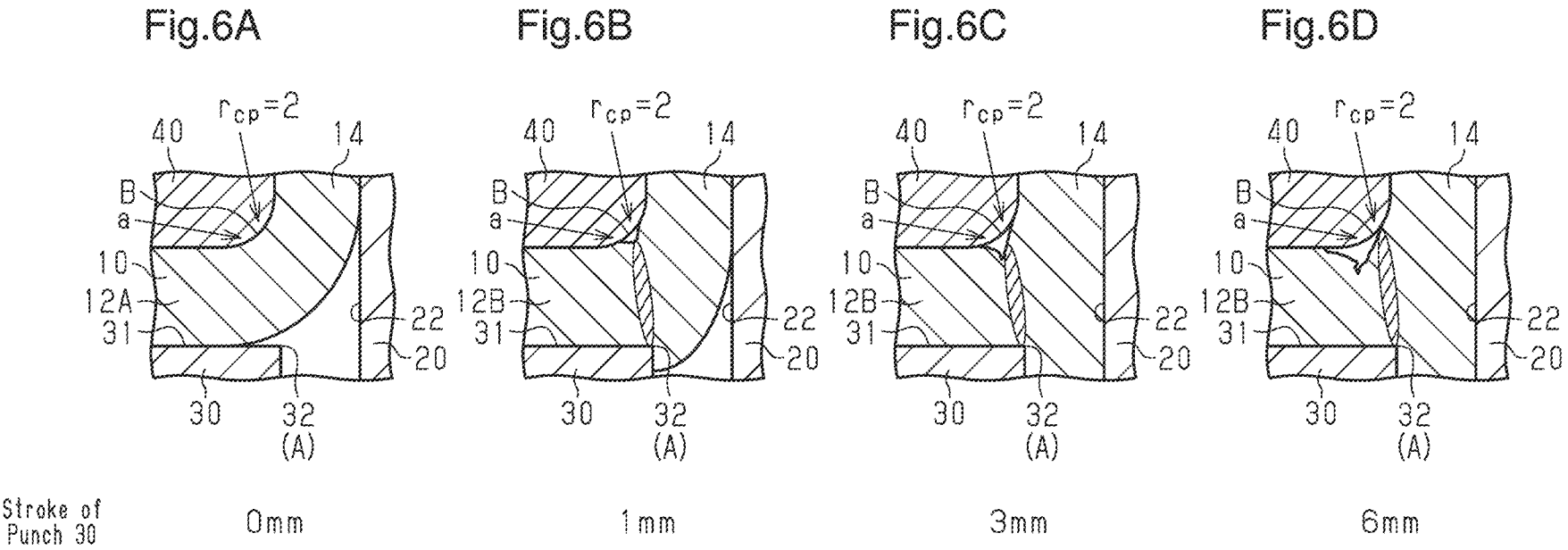
FIG. 6A is an enlarged cross-sectional view showing the vicinity of an edge of an inner surface of a bottom portion (vicinity of corner of counter punch) when cut forging is started.
FIG. 6B is an enlarged cross-sectional view showing a portion where a sink is formed in the vicinity of the edge of the inner surface of the bottom portion (vicinity of corner of counter punch) in a stage subsequent to FIG. 6A.
FIG. 6C is an enlarged cross-sectional view showing the portion where the sink is formed in the vicinity of the edge of the inner surface of the bottom portion (vicinity of corner of counter punch) in a stage subsequent to FIG. 6B.
FIG. 6D is an enlarged cross-sectional view showing the portion where the sink is formed in the vicinity of the edge of the inner surface of the bottom portion (vicinity of corner of counter punch) in a stage subsequent to FIG. 6C.

FIGS. 6A to 6D show an example of a simulation in which a sink was formed. FIG. 6A shows a case in which the shoulder radius rep of the joint line B in the inner surface of the bottom portion 12A was 2 mm, and the movement amount of the punch 30 was 0. In the state prior to cutting shown in FIG. 6A, there is no stress. FIGS. 6B to 6D respectively show cases in which the movement amount of the punch 30 from the state of FIG. 6A were 1 mm, 3 mm, and 6 mm. A sink having an acute shape is formed in the vicinity of the joint line B in the inner surface of the bottom portion 12B, and the size of the sink increases as the movement amount increases. The example of FIG. 6D shows the sink having grown to a length that is approximately 30% of the thickness of the bottom portion 12B.

The boundary region when the recess including the gradually recessed surface is formed and the boundary region when the sink is formed were searched for in the simulations. In one example of a simulation, the metal material 10 was SPCC, and the simulation was conducted under the conditions of $t_0$=1 mm, $t_c$=$t_{c0}$)=1 mm, 2 mm, and 4 mm, and d=62 mm. Combinations of the cutting amount $t_0$ and the thickness $t_{c0}$ of the bottom portion 12A were simulated, and simulations results H1 to H5, J1 to J9, and L1 to L5 were obtained (refer to FIG. 7).

Further, the flow stress σ satisfied $\sigma=501\varepsilon^{0.24}$ MPa, the back pressure Pb/C of the counter punch 40 was 0.005, and the friction coefficient $\mu_p$ between the counter punch 40 and the metal material satisfied $\mu_p$=0.1. Here, $t_{c0}$ is the thickness $t_{c0}$ of the bottom portion 12A of the metal material 10 prior to cut forging.

Figure 7:
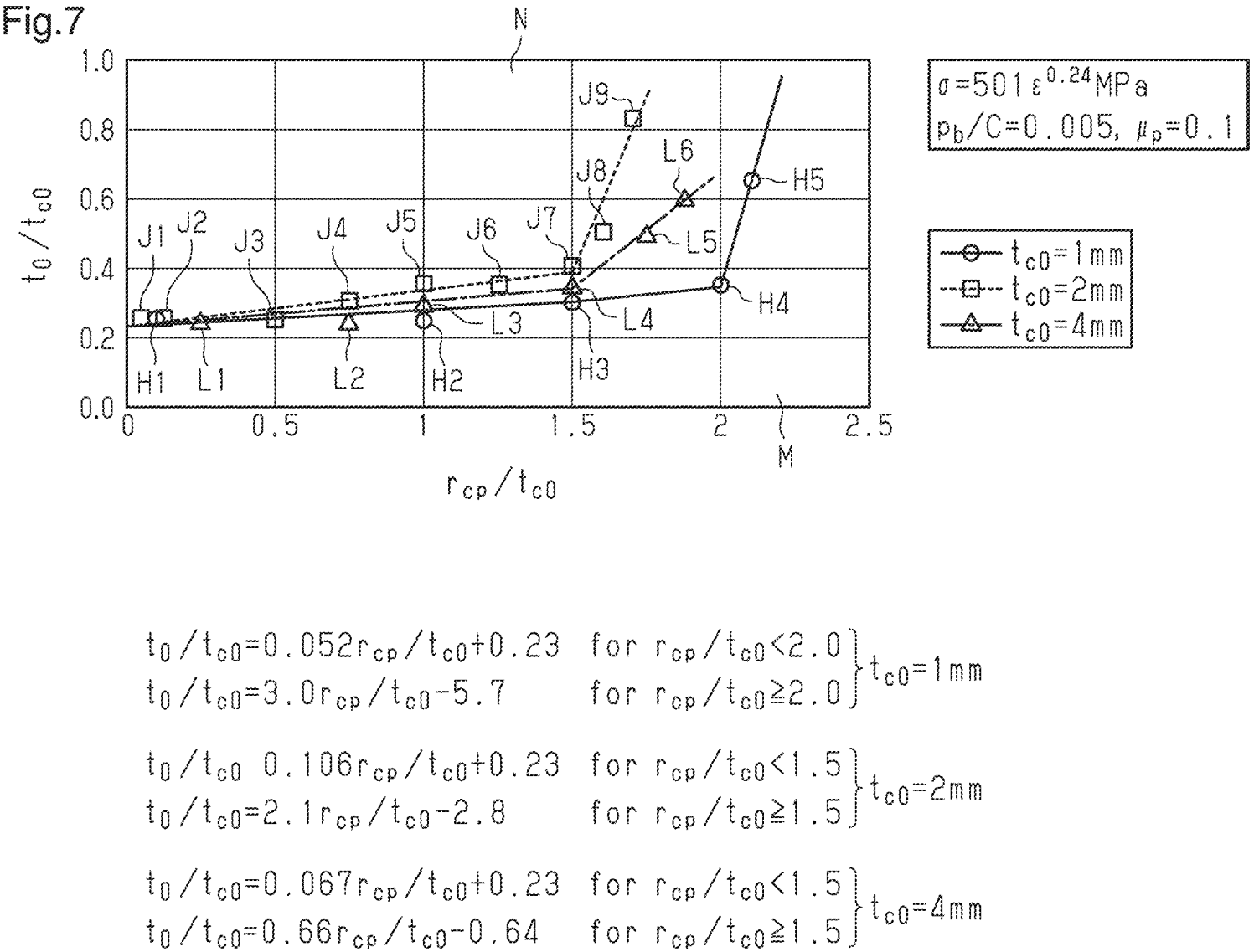
FIG. 7 is a characteristics diagram of a region where a sink forms and a region where a sink does not form.

The simulation results are shown in the characteristics diagram of FIG. 7. In FIG. 7, the vertical axis is $t_0/t_{c0}$, and the horizontal axis is $r_{cp}/t_{c0}$. As shown in the drawing, a regression analysis was conducted on simulation ($r_{cp}$, $t_0/t_{c0}$) results H1 to H5, J1 to J9, and L1 to L6 to obtain the line of $t_0/t_{c0}$ parting cases where a sink was formed from cases where a recess N including a gradually recessed surface was formed. The right-hand side of in equations (1), (2), and (13) to (16) are in equations representing the line.

Here, H1 to H5 are the simulation results when $t_{c0}$=1 mm was satisfied, J1 to J9 are the simulation results when $t_{c0}$=2 mm was satisfied, and L1 to L6 are simulation results when $t_{c0}$=4 mm was satisfied. The diameter of the punch 30 was $2t_0$ mm greater than the inner diameter of the circumferential wall 14.

<Case in which Bottom Portion 12A Satisfied Thickness $t_{c0}$=1 mm, and $r_{cp}/t_{c0}$<2.0 was Satisfied>

$$t_0/t_{c0} \geq 0.052 r_{cp}/t_{c0} + 0.23 \quad (1)$$

Thus, when the thickness td) of the bottom portion 12A is 1 mm and $r_{cp}/t_{c0}$<2.0 is satisfied, it is preferred that the condition be set to satisfy in equation (1) for sink prevention.

<Case in which Bottom Portion 12A Satisfied Thickness $T_{c0}$=1 mm, and $r_{cp}/t_{c0} \geq 2.0$ was Satisfied>

$$t_0/t_{c0} \geq 3.0 r_{cp}/t_{c0} - 5.7 \quad (2)$$

Thus, when $t_{c0}$ is 1 mm and $r_{cp}/t_{c0} \geq 2.0$ is satisfied, it is preferred that the condition be set to satisfy in equation (2) for sink prevention.

<Case in which Bottom Portion 12A Satisfied Thickness $t_{c0}$=2 mm, and $r_{cp}/t_{c0}$<1.5 was Satisfied>

$$t_0/t_{c0} \geq 0.106 r_{cp}/t_{c0} + 0.23 \quad (13)$$

Thus, when $t_{c0}$ is 2 mm and $r_{cp}/t_{c0}$<1.5 is satisfied, it is preferred that the condition be set to satisfy in equation (13) for sink prevention.

<Case in which Bottom Portion 12A Satisfied Thickness $t_{c0}$=2 mm, and $r_{cp}/t_{c0} \geq 1.5$ was Satisfied>

$$t_0/t_{c0} \geq 2.1 r_{cp}/t_{c0} - 2.8 \quad (14)$$

Thus, when $t_{c0}$=2 mm is satisfied and $r_{cp}/t_{c0} \geq 1.5$ is satisfied, it is preferred that the condition be set to satisfy in equation (14) for sink prevention.

<Case in which Bottom Portion 12A Satisfies Thickness $t_{c0}$=4 mm, and Rep/$t_{c0}$<1.5 is Satisfied>

$$t_0/t_{c0} \geq 0.067 r_{cp}/t_{c0} + 0.23 \quad (15)$$

Thus, when $t_{c0}$ is 4 mm and $r_{cp}/t_{c0}$<1.5 is satisfied, it is preferred that the condition be set to satisfy in equation (15) for sink prevention.

<Case in which Bottom Portion 12A Satisfies Thickness $t_{c0}$=4 mm, and Rep/$t_{c0} \geq 1.5$ is Satisfied>

$$t_0/t_{c0} \geq 0.066 r_{cp}/t_{c0} - 0.64 \quad (16)$$

Thus, when $t_{c0}$ is 4 mm and $r_{cp}/t_{c0} \geq 1.5$ is satisfied, it is preferred that the condition be set to satisfy in equation (16) for sink prevention.

Even when a sink is formed, the sink may not cause no trouble in the forged product. Thus, there is no limitation to the values and the in equations (1), (2), and (13) to (16).

The simulation results when the thickness of the bottom portion 12A was set to 1 mm, 2 mm, and 4 mm have been described. However, for example, in the case of the commercially available thickness of 0.1 mm, even when the thickness $t_{c0}$ of the bottom portion 12A is 0.1 mm and $r_{cp}/t_{c0}$<2.0 is satisfied, as long as the condition is set to satisfy in equation (1), a recess including a gradually recessed surface will be obtained without a sink.

Further, even when the thickness $t_{c0}$ of the bottom portion 12A is 0.1 mm and $r_{cp}/t_{c0} \geq 2.0$ is satisfied, as long as the condition is set to satisfy in equation (2), a recess including a gradually recessed surface will be obtained without a sink.

In the same manner, in the case of an extremely thick bottom portion, for example, when the thickness $t_{c0}$ of the bottom portion 12A is 20 mm and $r_{cp}/t_{c0}$<2.0 is satisfied, as long as the condition is set to satisfy in equation (1), a recess including a gradually recessed surface will be obtained without a sink.

Further, even when the thickness $t_{c0}$ of the bottom portion 12A is 20 mm and $r_{cp}/t_{c0} \geq 2.0$ is satisfied, as long as the condition is set to satisfy in equation (2), a recess including a gradually recessed surface will be obtained without a sink.

The present embodiment has the advantages described below.

(1) The precision forging method of the present embodiment arranges a metal material including the wall portion 14, which extends in a punch moving direction, and the bottom portion 12A (pre-working projecting wall), which extends from the wall portion 14 in a direction intersecting the moving direction, in the die cavity 22 of the die 20 and moves the punch 30 to forge the metal material 10.

In the first step, the punch 30 including the working end surface 31 and the cutting blade 32 formed at the edge of the working end surface 31 is arranged in the die cavity 22 so that the punch 30 is opposed toward the metal material 10, that is, opposed toward part of the wall portion 14 thickness-wise and the bottom portion 12A (pre-working projecting wall).

In the second step, in a state in which the metal material 10 is held in the moving direction of the punch 30 and the length of the bottom portion 12A (pre-working projecting wall) in the intersecting direction is maintained, the punch 30 is moved within the range of the height of the wall 14 so that its blade cuts the part of the wall portion 14 thickness-wise in the moving path of the punch 30 and causes shear deformation in the cut part to move the cut part toward the bottom portion 12A (pre-working projecting wall). When the punch 30 is opposed toward the entire circumferential wall 14 thickness-wise, the punch 30 cuts the entire circumferential wall 14 thickness-wise in the moving path with the blade and causes shear deformation in the cut part to move the cut part toward the bottom portion 12A (pre-working projecting wall).

Consequently, the present embodiment differs from the prior art in that precision forging can be performed with a low tool pressure. That is, massive tool pressure is not required during precision forging. Further, a chip formation mechanism is implemented during cutting. Thus, chips do not have to be separated from the metal material and can be used as part of the product. Further, since massive tool pressure is not required, the precision forging can be applied to hollow components formed from high-strength material having large dimensions and complicated cross-sectional shapes.

In the second step, the bottom portion 12A (pre-working projecting wall) is held to maintain the dimension in the intersecting direction. Thus, there is no risk of material cracking at the portion of the circumferential wall cut by the punch blade. The precision forging of the present embodiment may be referred to as cut forging that is a novel concept and provides a third basic working process in addition to the two basic working processes of upsetting and extrusion.

(2) In the first step of the precision forging method in accordance with the present embodiment, the metal material 10, which includes a fit region where at least part of the wall portion 14 comes into plane contact with the wall surface of the die cavity 22 and the bottom portion 12A (pre-working projecting wall) located at the side opposite to the fit region, is arranged in the die cavity 22, and the cutting blade 32 of the punch 30 is arranged spaced apart from the wall surface of the die cavity 22 by a distance smaller than the thickness of the wall portion 14. Further, in the second step, the metal material 10 is cut by the cutting blade 32 so that the fit region remains in the wall portion 14. As a result, the remaining fit region allows the part of the remaining circumferential wall 14 to be tubular. When a punch that does not include the cutting blade 32 and differs from the present embodiment is used to move the entire fit region toward the bottom portion (pre-working projecting wall), the part will be deformed to obtain a non-tubular shape.

(3) In the precision forging method of the present embodiment, when the punch 30 corresponds to the first punch, the counter punch 40 that corresponds to the second punch is located at the side of the bottom portion 12A opposite to the punch 30. In the second step, the counter punch 40 is moved so as to follow the movement of the punch 30 in the moving direction.

As a result, the counter punch, to which a constant back pressure is applied, moves the sheared and discharged chips toward the node (bottom portion) and compresses the chips so that the bottom portion forms a hardened part.

(4) In the precision forging method in accordance with the present embodiment, when the cutting amount is expressed by $t_0$, the radial length of the punch 30 is greater by $2t_0$ mm than the inner diameter of the circumferential wall 14. When the shoulder radius $r_{cp}$ and the thickness $t_{c0}$ of the bottom portion 12A (pre-working projecting wall) satisfy $r_{cp}/t_{c0}<2.0$, the metal material 10 is worked so that $t_0/t_{c0}$ satisfies in equation (1), which is shown below.

$$t_0/t_{c0} \geq 0.052 r_{cp}/t_{c0} + 0.23 \quad (1)$$

When the shoulder radius $r_{cp}$ and the thickness $t_{c0}$ of the bottom portion 12A (pre-working projecting wall) satisfies $r_{cp}/t_{c0} \geq 2.0$, the metal material 10 is worked so that $t_0/t_{c0}$ satisfies in equation (2), which is shown below.

$$t_0/t_{c0} \geq 3.0 r_{cp}/t_{c0} - 5.7 \quad (2)$$

As a result, when in equation (1) or in equation (2) are satisfied, a precision forging product that is free from sinks can be obtained.

(5) In the second step of the precision forging method in accordance with the present embodiment, the stopper 24 comes into contact with the circumferential wall 14 to hold the metal material 10 (specifically, wall, or circumferential wall 14) in the moving direction of the punch 30. As a result, in the second step, cutting is efficiently performed.

(6) The precision forging device includes the die 20 and the punch 30. The metal material 10 including the circumferential wall 14, which extends in the moving direction of the punch 30, and the bottom portion 12A, which extends from the circumferential wall 14 in a direction intersecting the moving direction, is arranged in the die cavity 22. The movement of the punch 30 forges the metal material 10. When the metal material 10 is arranged in the die cavity 22, the punch 30 is arranged opposed toward part of the circumferential wall 14 thickness-wise and the bottom portion 12A. The punch 30 includes the working end surface and the cutting blade 32, which is formed on the edge of the working edge surface. When the punch 30 is moved within the range of the height of the circumferential wall 14, the cutting blade 32 cuts part of the circumferential wall 14 thickness-wise in the moving path of the punch 30 and causes shear deformation in the cut part.

As a result, forging can be performed with a tool pressure that is less than that of the prior art, that is, a precision forging device that does not require a massive tool pressure during precision forging can be obtained.

The mechanism that forms chips during cutting is applied to precision forging. Thus, in the obtained precision forging device, chips do not have to be separated from the metal material and can be used as part of the product. Further, the present precision forging device does not require a massive tool pressure and can be applied to hollow components formed from high-strength material having large dimensions and complicated cross-sectional shapes.

(7) The precision forging device of the present embodiment includes the stopper 24 that comes into contact with the distal end surface of the circumferential wall 14 when the punch 30 is moved within the range of the height of the circumferential wall 14, thereby holding the metal material 10 in the moving direction of the punch 30. This obtains a precision forging device that performs cutting efficiently.

(8) The precision forging product in accordance with the present embodiment includes the circumferential wall 14, which extends in the first direction that is the axial direction, and the bottom portion 12B, which extends from the circumferential wall 14 in a second direction that is the radial direction intersecting the first direction. The bottom portion 12B includes the first surface, which is at the side where the joint line A between the circumferential wall 14 and the bottom portion 12B is located, and the second surface, which is at the side opposite to the first surface. The precision forging product includes the metal flow W extending from the joint line A to the joint line B in the second surface. As a result, the precision forging product can be manufactured with a precision forging device that does not require a massive tool pressure. That is, the precision forging product in accordance with the present embodiment can be obtained with a small tool pressure. More specifically, the precision forging product of the present embodiment does not require a massive tool pressure during precision forging. Further, chips do not have to be separated during cutting and can be used as part of the precision forging product. Since a massive tool pressure is not required, the precision forging product can be a hollow component formed from high-strength material having large dimensions and a complicated cross-sectional shape.

(9) The precision forging product in accordance with the present embodiment includes the circumferential wall 14, which serves as a wall portion and extends circumferentially, and the bottom portion 12B, which is formed on the inner surface of the circumferential wall 14. As a result, the precision forging product including the circumferential wall and the bottom portion has advantage (8).

EXAMPLES

Examples will now be described with reference to FIGS. 8A to 8D, 9A. 9B, and 10. The conditions of the examples are as shown in table 2

TABLE 2

| Example Conditions | | |
|---|---|---|
| Parameter | Unit | Value |
| (Drawing) | | |
| Worked Material | | SPCC |
| Worked Material Thickness | mm | 1.93 |
| Worked Material Diameter | mm | 100 |
| Punch Diameter | mm | 60 |
| Punch Shoulder Radius | mm | 10 |
| Die Diameter | mm | 64.2 |
| Die Shoulder Radius | mm | 12 |
| (Ironing) | | |
| Punch Diameter | mm | 60 |
| Punch Shoulder Radius | mm | 0.1 |
| Die Diameter | mm | 63.66 |
| (Cut Forging) | | |
| Punch Diameter d | mm | 62 |
| Punch Shoulder Radius $r_p$ | mm | 0.1 |
| Punch Speed V | mm/s | 5.8 |
| Counter Punch Diameter $d_{cp}$ | mm | 60 |
| Counter Punch Shoulder Radius $r_{cp}$ | mm | 0.1 |
| Counter Punch Back Pressure Pb/C | | 0.05 |

The flow stress a of the metal material 10 is expressed by $\sigma=501\varepsilon^{0.24}$ MPa. The initial flow stress of the metal material 10 was 193 MPa, and the plasticity coefficient of the metal material 10 was 501 MPa. The metal material 10 was obtained by cutting a circular plate having a diameter of 100 mm from a sheet of cold-rolled steel having a thickness of 1.93 mm. The tool used in the manufacturing process was formed from high-speed tool steel (SKH51(=HRC63)). A coating of TiAlN was applied to the tool for forging work in order to prevent scuffing. The used lubricant was G-3764 (manufactured by Nihon Kohsakuyu Co., Ltd, viscosity at 40°: $550\times10^{-6}$ $m^2/s$). Forging was performed with a 1100 kN servo press machine. The load on the punch 30 during forging was measured with a strain gauge arranged on the back gate of the punch 30. Back pressure was applied to the counter punch 40 by an air cylinder.

Figure 8A:
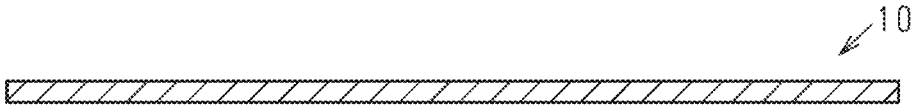
FIG. 8A is a cross-section diagram showing a steel plate of a metal material 10.
Figure 8B:
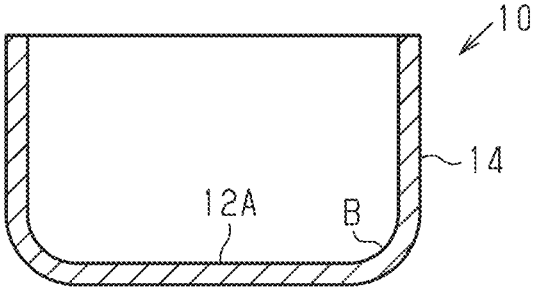
FIG. 8B is a cross-sectional view of the metal material 10 subsequent to drawing.

As shown by the drawing conditions in table 2, drawing was performed on the metal material 10 (refer to FIG. 8A), which is a steel sheet of SPCC (thickness 1.93 mm), to obtain the cup-shaped metal material 10 having the bottom portion 12 and the circumferential wall 14 formed around the edge of the bottom portion 12, as shown in FIG. 8B. For the drawing, the diameter of the punch (not shown) was 60 mm, the diameter of the die (not shown) was 64.2 mm, and the die shoulder radius was 12 mm.

The drawing set the joint line B in the inner surface of the bottom portion 12 (refer to FIG. 8B) to a radius of curvature (punch shoulder radius) of 10 mm.

Figure 8C:
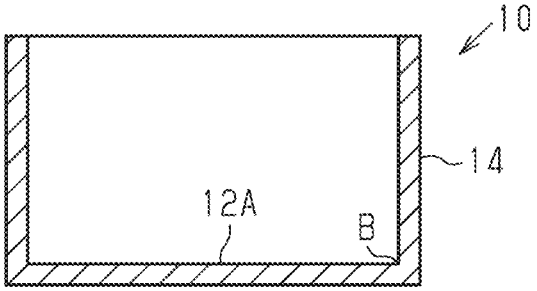
FIG. 8C is a cross-sectional view of the metal material 10 subsequent to ironing.
Figure 8D:
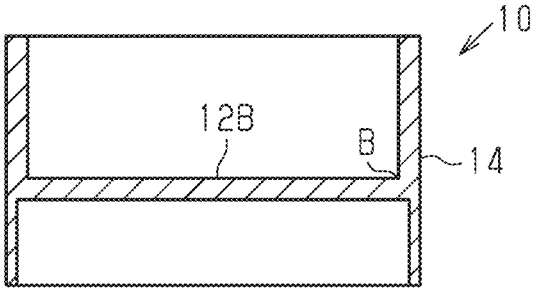
FIG. 8D is a cross-sectional view of the metal material 10 subsequent to precision forging.

Then, ironing was further performed to form the forging material cup shown in FIG. 8C. A punch (not shown) having a diameter of 60 mm and a die (not shown) having a diameter of 63.66 mm were used for the ironing. The ironing set the radius of curvature (punch shoulder radius) at the joint line B in the inner surface of the bottom portion 12 to 0.1 mm.

Then, the precision forging device 50 (refer to FIG. 1A and the like) was used to perform cut forging by setting the cutting amount to of the forging material cup to 1.0 mm and 2.0 mm and the speed V of the punch 30 to 5.8 mm/s. The die 20 used for cut forging was the same as the die used for ironing. When the cutting amount $t_0$=1.0 mm was satisfied, the punch 30 that was used had a diameter of 62 mm and the die 20 that was used had a diameter of 63.66 mm. Further, the counter punch 40 that was used had a diameter of 60 mm. The back pressure of the counter punch 40 was 0.05. The punch 30 had a thickness greater than or equal to that of the bottom portion 12 and was moved within a range less than or equal to the height of the circumferential wall 14.

In the shearing work (blanking work) of the prior art, the punch is moved from where it comes into contact with a plate material by an amount greater than or equal to the thickness of the plate material. However, this will break the bottom portion pushed by the punch. The present example differs from the prior art in that the bottom portion is not broken and moved within the range of the height of the circumferential wall together with the punch.

In half-blanking of the prior art, the punch is moved from where it comes into contact with a plate material by a moving amount that does not exceed the thickness of the plate. The present example differs from the prior art in that the bottom portion is moved within the range of the height of the circumferential wall together with the punch.

The cut forging set the radius of curvature of the inner surface and outer surface at the edge of the bottom portion 12 to 0.1 mm. The cut forging allowed the material forming the bottom portion 12 to be freely moved without any problem. The load on the punch 30 measured with a strain gauge, and the pushing force p/C of the punch 30 required for working was approximately 0.3 times the plasticity coefficient of the metal material 10.

Figure 9A:
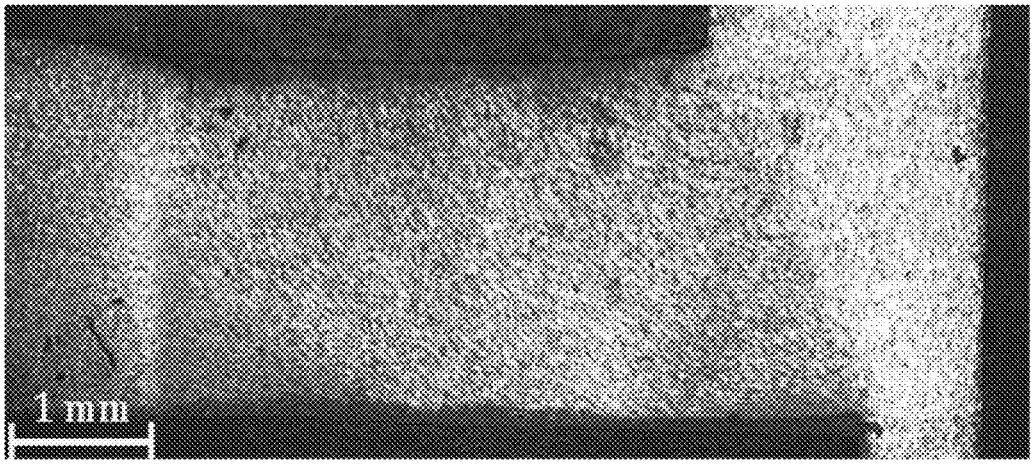
FIG. 9A is a cross-sectional photograph showing a forged product including a metal flow line.
Figure 9B:
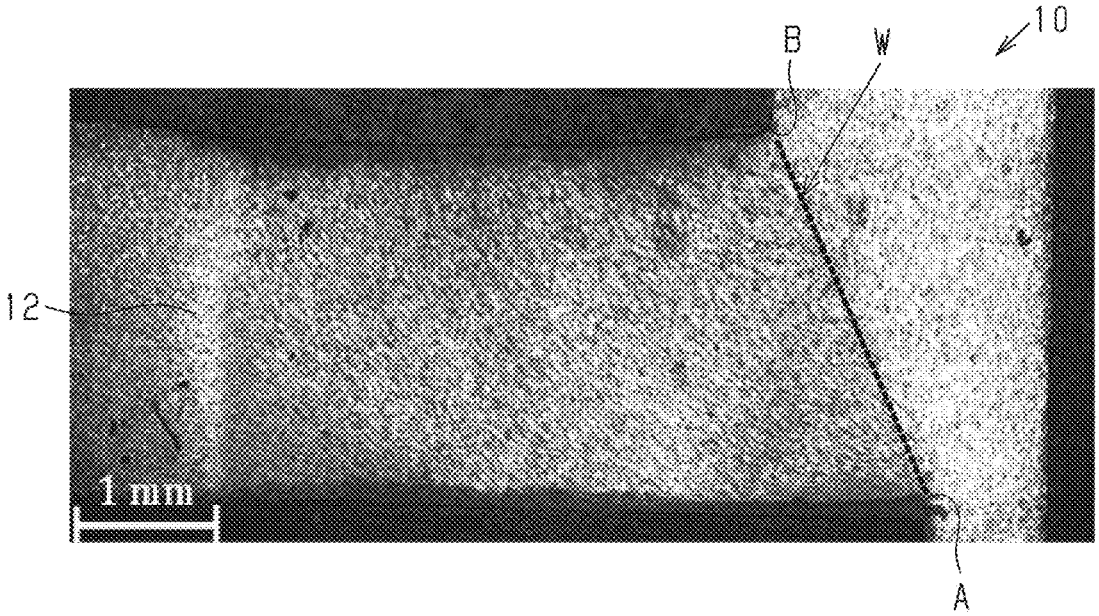
FIG. 9B is a cross-sectional photograph using a line to mark the metal flow line.

FIGS. 9A and 9B are photographs showing the cross section of the bottom portion 12 and the circumferential wall 14 taken by cutting the precision forging product formed as described above in the height-wise direction.

Figure 23:
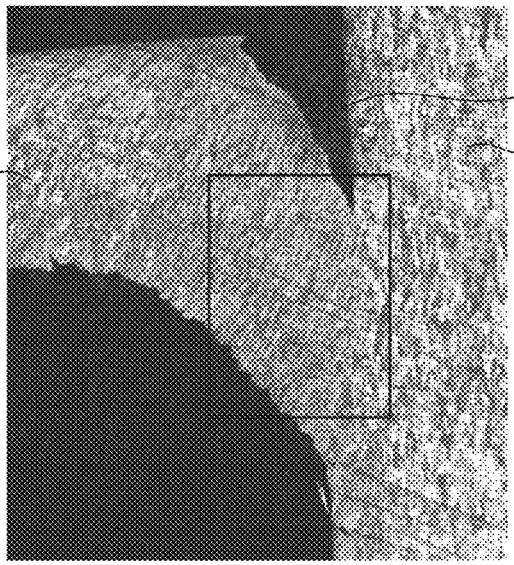
FIG. 23 shows a cut cross section of the portion connecting an outwardly directed flange and a circumferential wall when a shaved drawn cup of Non-Patent Document 1 is cut in the axial direction.
Figure 24:
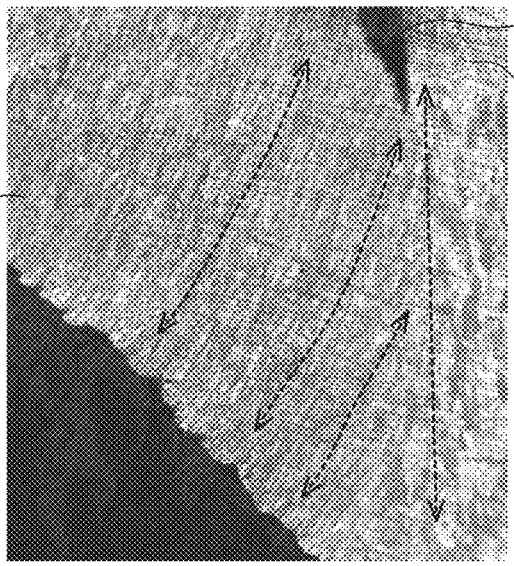
FIG. 24 shows an enlarged cross section of the portion inside the square frame in FIG. 23.

As shown by the broken line in FIG. 9B, a line indicating the metal flow W appeared in the portion subject to shear deformation because of the cut forging as shown in FIG. 9A. The metal flow W is unique to the present cut forging. To eliminate the metal flow W, the precision forging product will have to undergo heat treatment, which will greatly increase the cost. When comparing FIGS. 23 and 24 of the prior art example with FIGS. 9A and 9B of the present example, there is no metal flow W in the prior art example.

Figure 10:
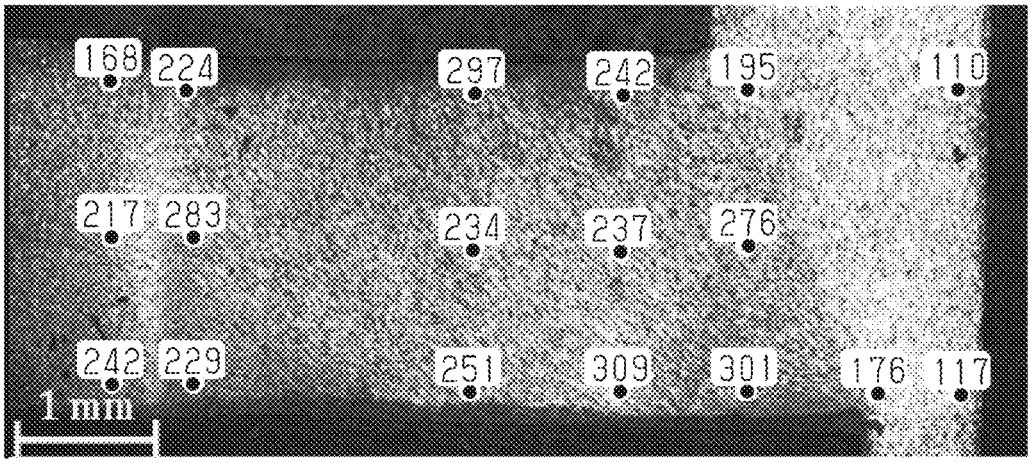
FIG. 10 is a cross-sectional photograph showing a cross-sectional portion of the forged product of FIG. 9A that was subject to a Vickers hardness test.

FIG. 10 shows the result of the Vickers hardness in the cross-section of the precision forming product formed as described above measured at multiple locations in the shearing region where shear deformation occurred (region of bottom portion 12 leftward from metal flow W in FIG. 9B) and the region surrounding the shearing region. The values indicate the Vickers hardness. As shown in FIG. 10, the Vickers hardness in the shearing region has values that are approximately two times greater than portions near the outer surface of the circumferential wall 14 in the precision forging product. Thus, the shearing region is harder than the peripheral region.

Second Embodiment

A precision forging device and a precision forging product in accordance with a second embodiment will now be described with reference to FIGS. 11A to 11D, 12A, and 12B. In the embodiments described below including the present embodiment, same reference numerals are given to those components that are the same as the corresponding components of the first embodiment.

Figure 11C:
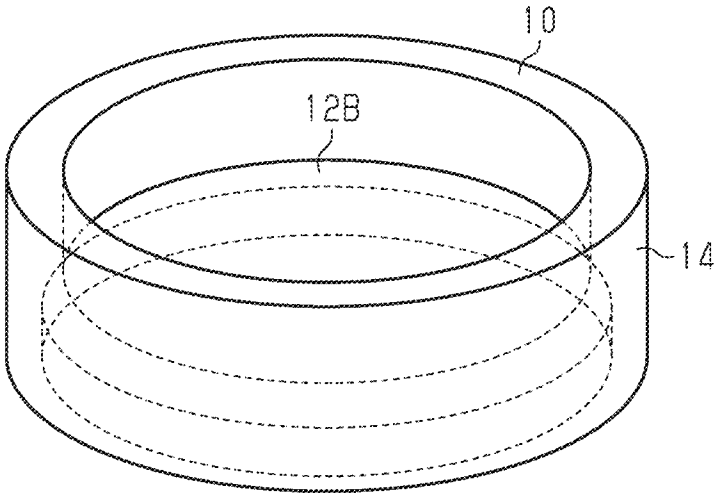
FIG. 11C is a perspective view of a precision forging product subsequent to working.
Figure 11A:
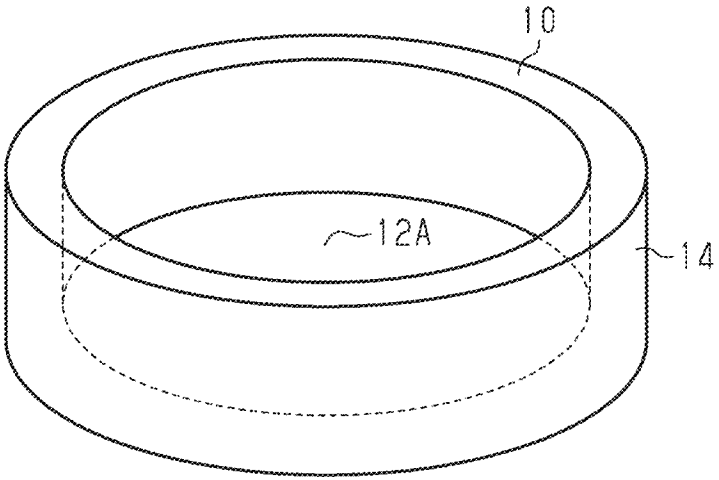
FIG. 11A is a perspective view of a metal material prior to working in accordance with a second embodiment.
Figure 11D:
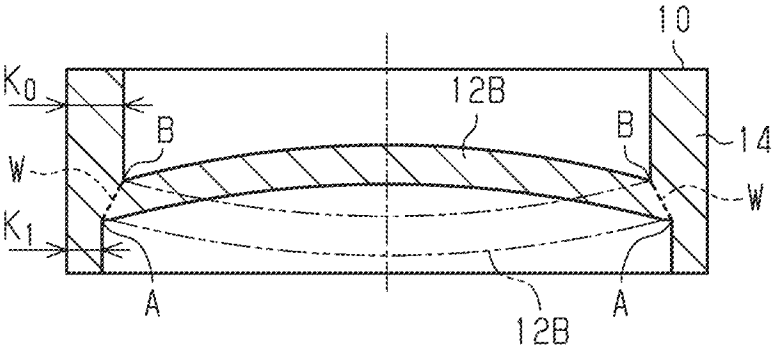
FIG. 11D is a vertical cross-sectional view of the precision forging product subsequent to working.
Figure 11B:
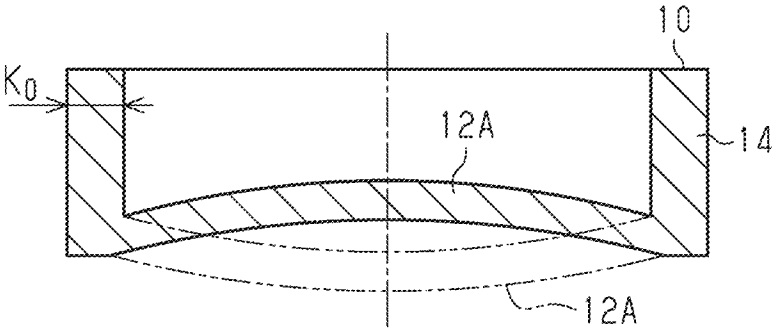
FIG. 11B is a vertical cross-sectional view of the metal material prior to working.

As shown in FIGS. 11A and 11B, the metal material 10 of the present embodiment prior to working includes the circumferential wall 14, which has the form of cylindrical tube in the same manner as the first embodiment, and the bottom portion 12A, which is coupled integrally with the lower part of the circumferential wall 14. The bottom portion 12 of the first embodiment is flat and extends in a direction intersecting the axial direction, namely, the radial direction, whereas the bottom portion 12A of the present embodiment includes an outer surface that is a concave surface, which is part of a spherical surface, and an inner surface that is a convex surface, which is part of a spherical surface.

As shown by the double-dashed lines in FIG. 11B, the bottom portion 12A may include an outer surface that is a convex surface, which is part of a spherical surface, and an inner surface that is a concave surface, which is part of a spherical surface.

Alternatively, although not shown in the drawings, the inner and outer surfaces of the bottom portion 12A may both be a concave surface, which is part of a spherical surface, or a convex surface, which is part of a spherical surface. That is, there is no limit to the plan view shape and cross-sectional shape of the bottom portion 12A.

The precision forging device 50 used in the present embodiment will now be described.

Figure 12A:
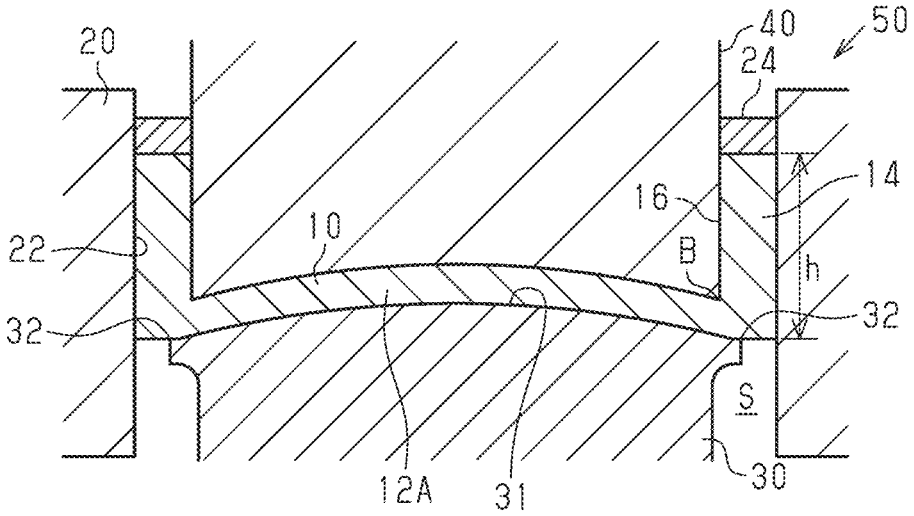
FIGS. 12A and 12B are diagrams illustrating steps of a precision forging method in accordance with the second embodiment.
Figure 12B:
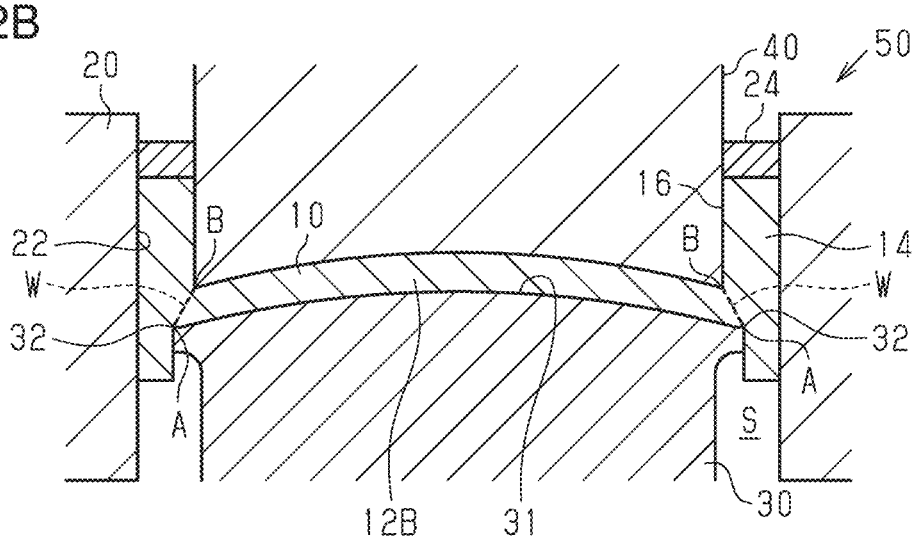

As shown in FIGS. 12A and 12B, in the same manner as the first embodiment, the precision forging device 50 includes the die 20, which has the die cavity 22, the punch 30, the stopper 24, and the counter punch 40.

In the first embodiment, the working end surface 31 of the punch 30 is flat. In contrast, as shown in FIGS. 12A and 12B, in the present embodiment, the working end surface 31 of the punch 30 has a convex surface conforming to the bottom portion 12A of the metal material 10. That is, as shown in FIG. 12A, the working end surface 31 is a convex surface, which is part of a spherical surface, to conform to the convex outer surface of the bottom portion 12A.

As shown in FIGS. 12A and 12B, the cutting blade 32 is formed along the entire circumference of the edge of the working end surface 31 of the punch 30. In the same manner as the first embodiment, the cutting blade 32 is formed to move continuous chips, which are produced when the bottom portion 12A (12B) of the metal material 10 is cut, toward the central portion (axis) of the punch 30. Otherwise, the structure is the same as the first embodiment.

The precision forging method according to the second embodiment is the same as the first embodiment and thus will not be described in detail. The first step is shown in FIG. 12A, and the second step is shown in FIG. 12B.

FIG. 11C is a perspective view of the precision forging product subsequent to working, and FIG. 11D is a vertical, cross-sectional view of the precision forging product subsequent to working. The bottom portion 12B shown by the double-dashed lines In FIG. 11D is the bottom portion 12B of the precision forging product obtained by working the pre-working metal material 10 that includes the bottom portion 12A shown by the double-dashed lines in FIG. 11B. In this case, although not shown in the drawings, the working end surface 31 of the punch 30 is concave to conform to the outer surface of the bottom portion 12A of the metal material 10.

The present embodiment has advantages (1) to (8) of the first embodiment.

Third Embodiment

A precision forging device and a precision forging product in accordance with a third embodiment will now be described with reference to FIGS. 13A to 13D, 14A, and 14B.

Figure 13C:
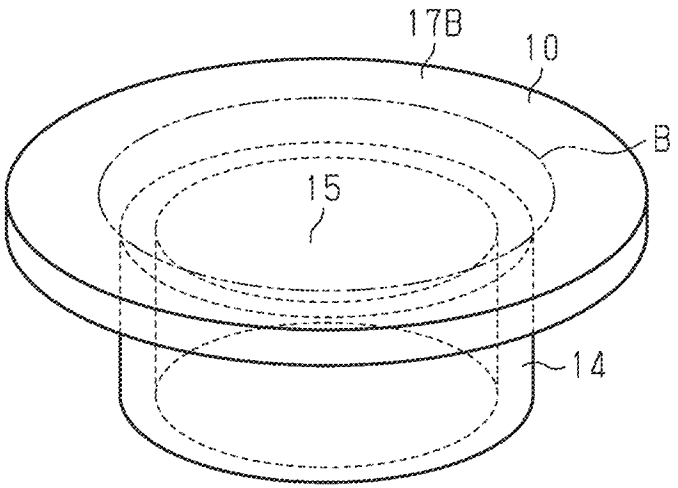
FIG. 13C is a perspective view of a precision forging product subsequent to working.
Figure 13A:
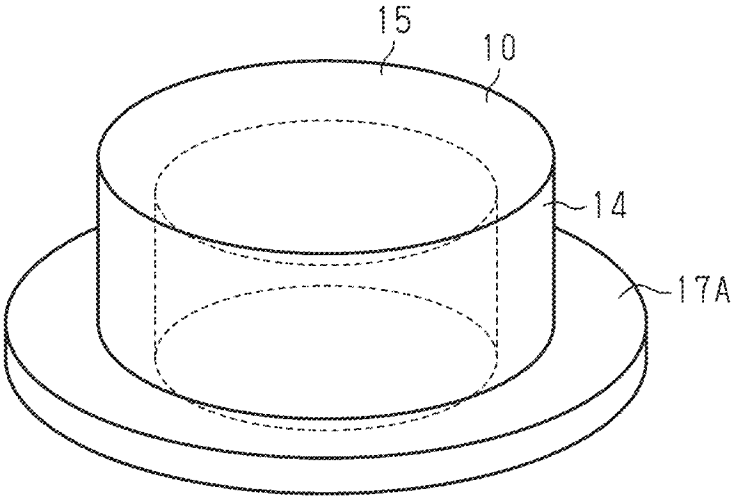
FIG. 13A is a perspective view of a metal material prior to working in accordance with a third embodiment.
Figure 13D:
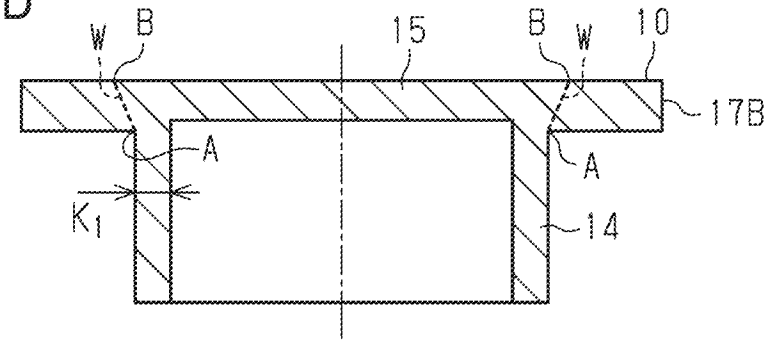
FIG. 13D is a vertical cross-sectional view of the precision forging product subsequent to working.
Figure 13B:
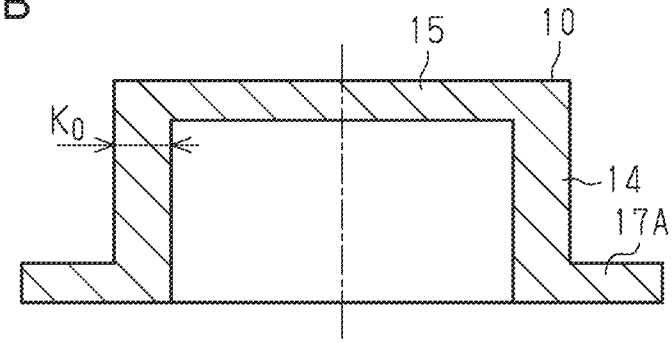
FIG. 13B is a vertical cross-sectional view of the metal material prior to working.

As shown in FIGS. 13A and 13B, the metal material 10 of the present embodiment prior to working includes the circumferential wall 14, which has the form of a cylindrical wall in the same manner as the first embodiment, a top wall 15, which closes the opening at one end of the circumferential wall 14, and an outwardly directed flange 17A, which is coupled integrally with the outer circumferential of the other end of the circumferential wall 14 and extended outward in the radial direction. The circumferential wall 14 extends in the first direction that is an axial direction. The flange 17A is flat and extends in a direction intersecting the axial direction, that is, in the radial direction.

The top wall 15 is flat and extends in a direction intersecting the axial direction, that is, in the radial direction, but does not have to be flat. The top wall 15 may include an outer surface that is a concave surface, which is part of a spherical surface, and an inner surface that is a convex surface, which is part of a spherical surface. Conversely, the top wall 15 may include an outer surface that is a convex surface, which is part of a spherical surface, and an inner surface that is a concave surface, which is part of a spherical surface. Alternatively, although not shown in the drawings, the inner and outer surfaces of the top wall 15 may both be a concave surface, which is part of a spherical surface, or a convex surface, which is part of a spherical surface. That is, there is no limit to the plan view shape and cross-sectional shape of the top wall 15.

The precision forging device 50 used in the present embodiment will now be described.

Figure 14A:
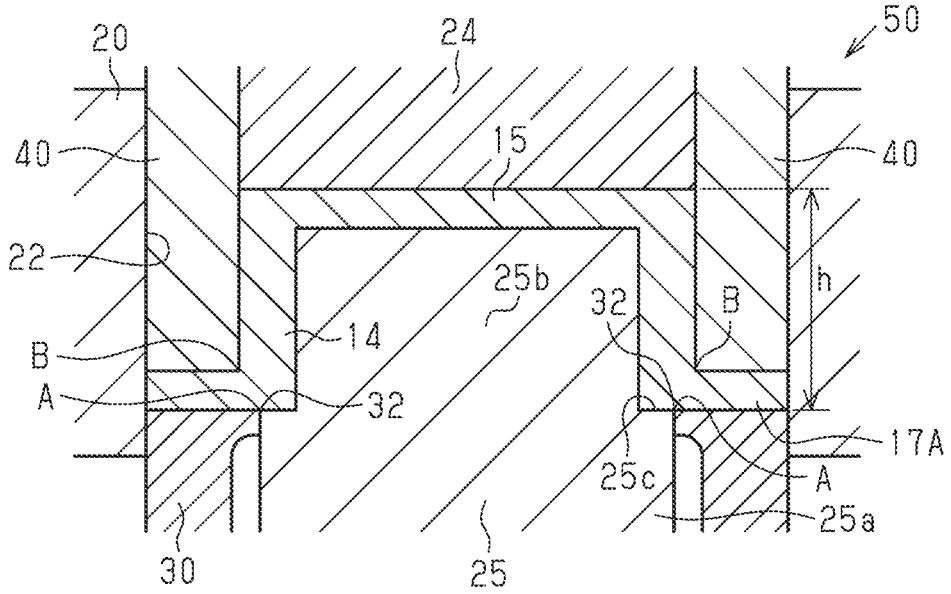
FIGS. 14A and 14B are diagrams illustrating steps of a precision forging method in accordance with a third embodiment.
Figure 14B:
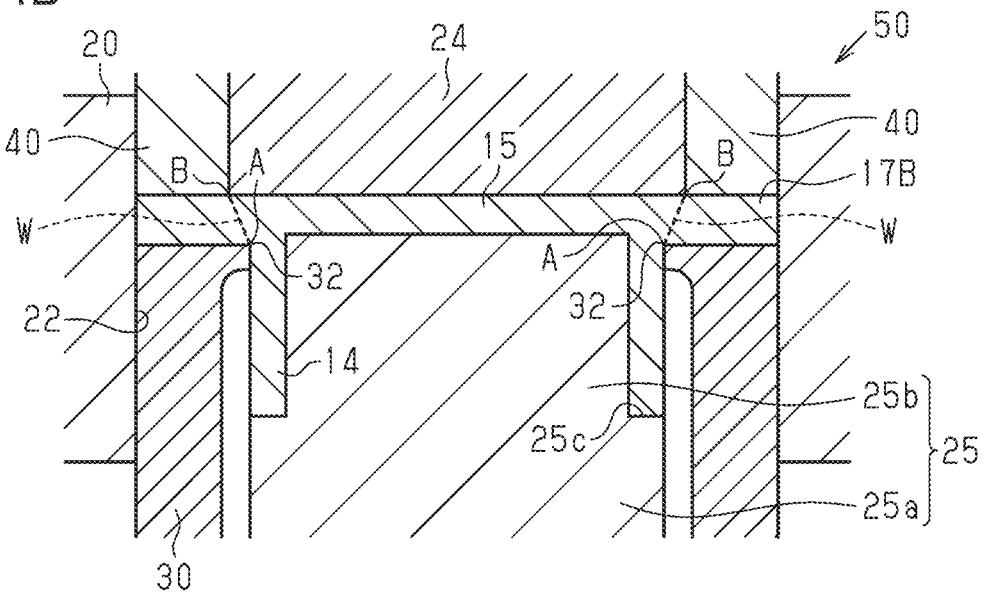

As shown in FIGS. 14A and 14B, the precision forging device 50 includes the die 20, which has the die cavity 22, the punch 30, the stopper 24, a knockout 25, and the counter punch 40. The cross-sectional shape of the die cavity 22 is circular but not limited and may have other shapes. The cross-sectional shape of the die cavity 22 may be in conformance but does not have to be in conformance with the contour shape of the flange 17A. When the flange 17A does not conform to the wall surface of the die cavity 22, it may be shaped so that at least a part comes into plane contact. In the present embodiment, the flange 17A is shaped in conformance to entirely come into plane contact with the wall surface of the die cavity 22.

As shown in FIGS. 14A and 14B, the punch 30 has the form of a cylindrical tube. The outer diameter of the punch 30 is equal to the inner diameter of the die cavity 22, and the cutting blade 32 is formed on the inner circumferential edge of the punch 30. The cutting blade 32 is formed to move continuous chips, which are produced when the circumferential wall 14 of the metal material 10 is cut, toward the radially outer side.

The cutting blade 32 of the punch 30, which has an inner diameter that is larger than the inner diameter of the circumferential wall 14 and smaller than the outer diameter of the circumferential wall 14, is arranged coaxially with the die cavity 22. That is, the cutting blade 32 is formed inward from the side (outer circumferential surface) of the flange 17A that comes into plane contact with the wall surface of the die cavity 22. Thus, the punch 30 is arranged opposed toward part of the circumferential wall 14 thickness-wise and the flange 17A. Further, the cutting blade 32 is arranged so as to allow shear deformation to occur in part of the circumferential wall 14 thickness-wise, that is, the outer circumferential region of the circumferential wall 14 located radially outward from the inner circumferential edge of the cutting blade 32.

The stopper 24, which is arranged coaxially with the die cavity 22, has a transverse cross section that is circular to conform to the contour shape of the top wall 15 of the metal material 10, as shown in FIG. 14A. The stopper 24 is arranged to contact the outer surface of the top wall 15 when shear deformation occurs in the outer circumferential region of the circumferential wall 14 located radially outward from the cutting blade 32. The stopper 24 only has to hold the metal material 10 when the metal material 10 is cut. Thus, the stopper 24 does not have to conform to the other shape of the top wall 15 and may be shorter in length in the radial direction than the top wall 15 or have a non-circular shape.

The knockout 25 includes a main body portion 25*a* having a circular cross section and a fitting portion 25*b* having a circular cross section with a smaller diameter than the main body portion 25*a*. The fitting portion 25*b* has the same diameter as the diameter of the inner hollow of the circumferential wall 14 and can be freely fitted into and removed from the circumferential wall 14. When the circumferential wall 14 of the metal material 10 does not have the form of a cylindrical tube and has a non-circular cross section, the fitting portion 25*b* may have a cross-sectional shape conforming to the cross-sectional shape of the inner surface of the circumferential wall 14.

An engagement step 25*c* is formed between the main body portion 25*a* and the fitting portion 25*b*. The engagement step 25*c* is engaged with the end surface of the circumferential wall 14 when the fitting portion 25*b* is fitted into the circumferential wall 14. The main body portion 25*a* has an outer diameter set to be proximate to the cutting blade 32. When the punch 30 is moved in the die cavity 22, the inner circumferential side of the circumferential wall 14, which is in contact with the engagement step 25*c*, remains unaffected.

The counter punch 40 opposed toward the punch 30 has the form of a cylindrical tube and is arranged to contact the flange 17A when entering the open space surrounded by the circumferential wall 14 of the metal material 10 and the wall surface of the die cavity 22. Further, an air cylinder or the like (not shown) applies back pressure to the counter punch 40 so that the counter punch 40 constantly presses the flange 17A. The punch 30 corresponds to the first punch, and the counter punch 40 corresponds to the second punch. The counter punch 40 is not an essential element and may be omitted.

A precision forging method in accordance with the present embodiment will now be described.

First Step

As shown in FIG. 14A, in a first step, the metal material 10, which includes the flange 17A and the circumferential wall 14, is arranged in the die cavity 22 of the die 20 of the precision forging device 50 so that the outer surface of the top wall 15 comes into contact with the stopper 24. In this state, the circumferential wall 14 is arranged in the die cavity 22 so as to extend in the punch moving direction, and the flange 17A is arranged so as to extend in a direction intersecting the punch moving direction. The punch moving direction coincides with the axial direction of the circumferential wall 14. Further, the outer circumferential surface of the flange 17A is in plane contact with the wall surface of the die cavity 22.

The punch 30 is arranged in the die cavity 22 so as to be opposed toward the flange 17A and part of the circumferential wall 14 thickness-wise. The part of the circumferential wall 14 thickness-wise that is opposed toward the punch 30 is an outer circumferential region of the circumferential wall 14 located radially outward from the inner circumferential edge of the cutting blade 32.

Second Step

In a second step, the punch 30 is moved toward the flange 17A to press and cut the circumferential wall 14 with the cutting blade 32. In this state, the metal material 10 remains held by the stopper 24 in the moving direction of the punch 30. The moving amount of the punch 30 from when the punch 30 initially contacts the flange 17A is in a range from greater than or equal to the thickness of the flange 17A and less than the height h of the circumferential wall 14 (refer to FIG. 14A).

As the punch 30 presses the flange 17A and cuts part of the circumferential wall 14 thickness-wise with the cutting blade 32, shear deformation caused by the cutting blade 32 occurs between the joint line A of the flange 17A (17B), which comes into contact with the cutting blade 32 formed on the working end surface of the punch 30, and the joint line B, which is located between the flange 17A (17B) and the outer surface of the circumferential wall 14. The reference character "17A" denotes the flange prior to cutting, and the reference character "17B" denotes the flange during and subsequent to cutting. The flange 17A corresponds to a pre-working projecting wall. The flange 17B corresponds to a post-working projecting wall.

The material (chips) cut and sheared by the cutting blade 32, is moved into the flange 17A (node) between the punch 30 and the counter punch 40 thereby forming the metal flow W between the joint line A and the joint line B, as viewed in FIG. 14A.

FIG. 14B is a diagram illustrating a state when cutting has ended where the flange 17B becomes flush with the outer surface of the top wall 15. As shown in FIG. 14B, the metal flow W extends from the portion denoted by reference character "B" to the portion demoted by reference character "A." In FIG. 14B, the portion denoted by reference character "B" is where the joint line B was located until just before the flange 17B became flush with the outer surface of the top wall 15. Even when the flange 17B becomes flush with the outer surface of the top wall 15, the joint line B will be left as a trace. The surface of the flange 17B at the side where the joint line A is located corresponds to a first surface, and the surface of the flange 17B at the side opposite to the first surface corresponds to a second surface.

The flange 17A, 17B is constrained by the die 20 so that the dimensions do not change in the direction intersecting the moving direction of the punch 30, as viewed in FIGS. 14A and 14B. Thus, as the working performed by the punch 30 progresses, the material (chips) is compressed and moved toward the node to increase the thickness of the node.

In the same manner as the first embodiment, the back pressure Fb applied to the counter punch 40 is much smaller than the pushing force F of the punch 30, that is, $Fb \ll F$ is satisfied. As the thickness of the node increases as described above, the counter punch 40 is moved backward against the urging force (back pressure) applied by the air cylinder or the like (not shown).

As shown in FIG. 14B, as the punch 30 presses the flange 17B and moves, the portion of the circumferential wall 14 located radially inward from the cutting blade 32, that is, the fit region, which is in plane contact with the outer circumferential surface of the fitting portion 25*b* of the knockout 25, remains unaffected.

After the cutting performed by the punch 30 ends, the stopper 24 and the counter punch 40 are separated from the die 20. Then, the knockout 25 is moved toward the stopper 24 to remove the metal material 10 from the die 20.

As a result, as shown in FIGS. 13C and 13D, in the metal material 10 subsequent to cutting, that is, in the precision forging product, the pre-working flange 17A, which is located at one end of the circumferential wall 14, is moved to the other end of the circumferential wall 14 and becomes the flange 17B. As shown in FIGS. 13B and 13D, the thickness of the post-working flange 17B is greater than the thickness of the pre-working flange 17A, and the circumferential wall 14 has a post-working thickness $K_1$ that is less than the pre-working thickness $K_0$.

The third embodiment has the advantages described below in addition to advantages (1), (3), and (5) to (7) of the second embodiment.

(10) The precision forging product in accordance with the present embodiment includes the circumferential wall 14, which extends in the first direction that is the axial direction, and the flange 17B, which extends from the circumferential wall 14 in the second direction that is the radial direction. The flange 17B includes the first surface, which is where the joint line A between the circumferential wall 14 and the flange 17B is located, and, the second surface, which is the side opposite to the first surface. The precision forging product includes the metal flow W extending from the joint line A to the joint line B in the second surface. As a result, the precision forging product can be manufactured with a precision forging device that does not require a massive tool pressure. That is, the precision forging product in accordance with the present embodiment can be obtained with a small tool pressure. More specifically, the precision forging product of the present embodiment does not require a massive tool pressure during precision forging. Further, chips do not have to be separated during cutting and can be used as part of the precision forging product. Since a massive tool pressure is not required, the precision forging product can be a hollow component formed from high-strength material having large dimensions and a complicated cross-sectional shape.

(11) The precision forging in accordance with the present embodiment includes the circumferential wall 14, which serves as a wall portion and extends circumferentially, and the outwardly directed flange 17B, which is formed on the outer surface of the circumferential wall 14. As a result, the precision forging product flange has advantage (10).

Fourth Embodiment

A precision forging device and a precision forging product in accordance with a fourth embodiment will now be described with reference to FIGS. 15A to 15D, 16A, and 16B. The present embodiment differs in part from the third embodiment. Thus, the description hereafter will focus on the differences.

Figure 15C:
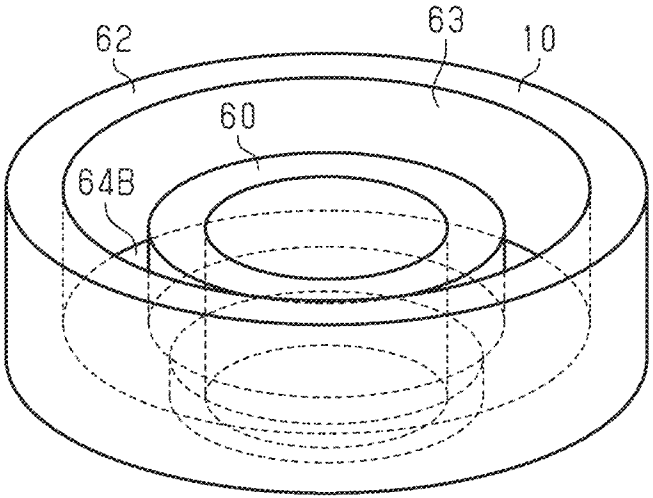
FIG. 15C is a perspective view of a precision forging product subsequent to working.
Figure 15D:
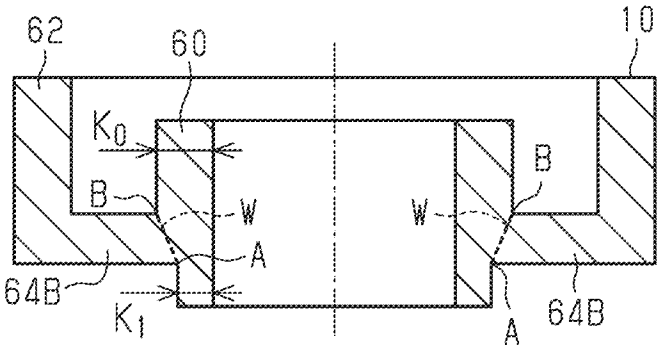
FIG. 15D is a vertical cross-sectional view of the precision forging product subsequent to working.
Figure 15A:
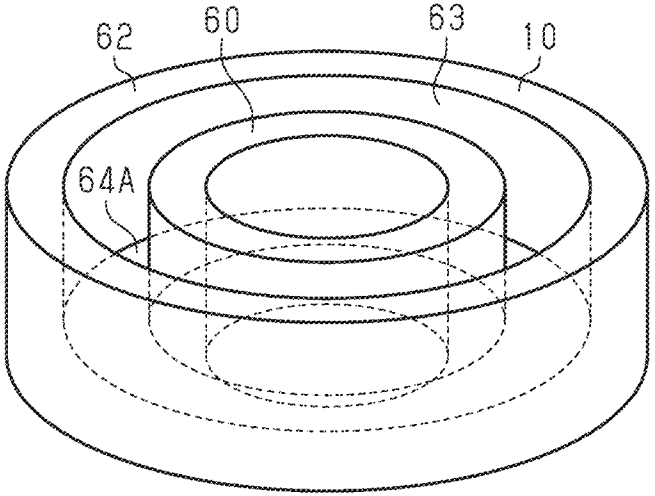
FIG. 15A is a perspective view of a metal material prior to working in accordance with a fourth embodiment.
Figure 15B:
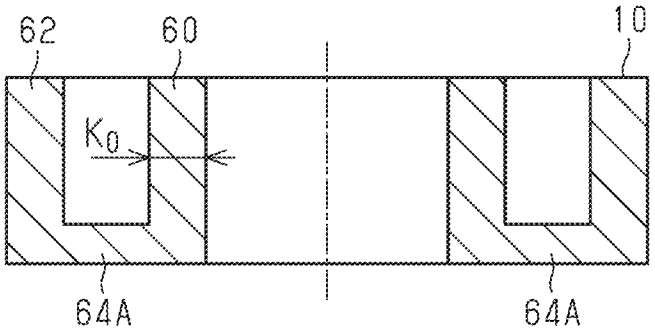
FIG. 15B is a vertical cross-sectional view of the metal material prior to working.
Figure 16A:
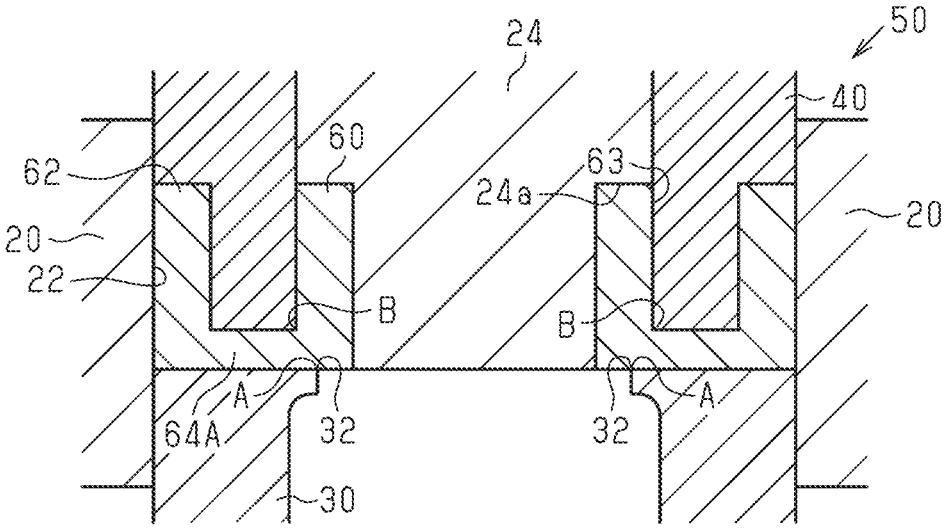
FIGS. 16A and 16B are diagrams illustrating steps of a precision forging method in accordance with the fourth embodiment.

As shown in FIGS. 15A and 15B, the metal material 10 of the present embodiment prior to working includes an inner tube 60 and an outer tube 62 that are arranged coaxially so as to form a duplex tube. One end of the inner tube 60 and one end of the outer tube 62 are coupled integrally by a bottom portion 64A. A ring-shaped groove 63 extends between the inner tube 60 and the outer tube 62. The inner tube 60, which corresponds to a circumferential wall and a wall portion, has the form of a cylindrical tube and extends in a first direction that is an axial direction. As shown in FIG. 16A, the outer tube 62, which has the form of a cylindrical tube, has an outer diameter that is equal to an inner diameter of the die cavity 22 of the die 20 of the precision forging device.

The bottom portion 64A is flat and extends in a direction intersecting the axial direction, that is, in the radial direction.

The bottom portion 64A is flat and extends in a direction intersecting the axial direction, that is, in the radial direction, but does not have to be flat. The inner tube 60 and the outer tube 62 have circular cross sections but do not have to be circular and may be shaped differently.

The precision forging device 50 used in the present embodiment will now be described.

Figure 16B:
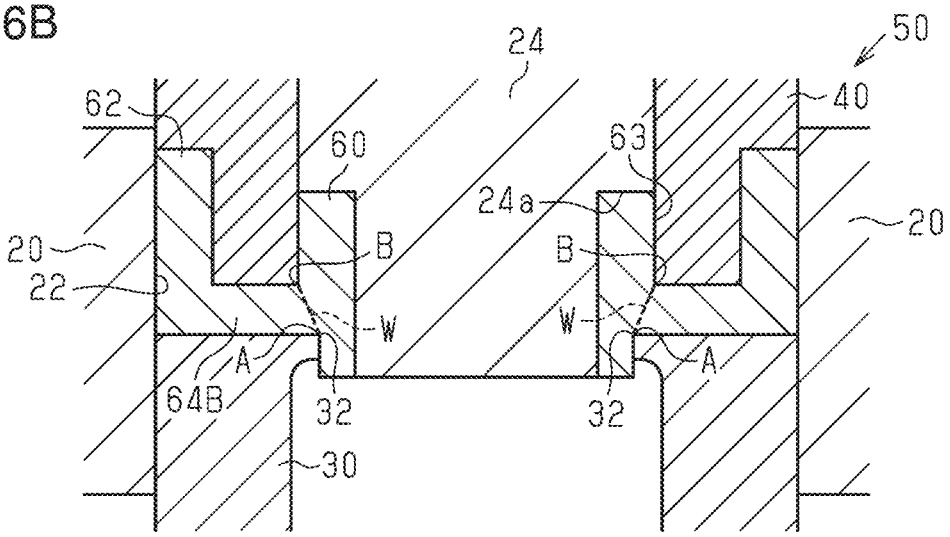

As shown in FIGS. 16A and 16B, the precision forging device 50 includes the die 20, which has the die cavity 22, the punch 30, the stopper 24, and the counter punch 40. The die cavity 22 has a circular cross section but is not limited to such a shape and only needs to conform to part of the contour shape of the outer tube 62.

As shown in FIGS. 16A and 16B, the punch 30 has the form of a cylindrical tube. The outer diameter of the punch 30 is equal to the inner diameter of the die cavity 22, and the cutting blade 32 is formed on the inner circumferential edge of the punch 30. The cutting blade 32 is formed to move continuous chips, which are produced when the circumferential wall 60 of the metal material 10 is cut, toward the radially outer side.

The cutting blade 32 of the punch 30, which has an inner diameter that is larger than the inner diameter of the inner tube 60 and smaller than the outer diameter of the inner tube 60, is arranged coaxially with the die cavity 22. Thus, the punch 30 is arranged opposed to part of the inner tube 60 thickness-wise and the bottom portion 64A. Further, the cutting blade 32 is arranged so as to allow shear deformation to occur in part of the inner tube 60 thickness-wise, that is, the outer circumferential region of the inner tube 60 located radially outward from the inner circumferential edge of the cutting blade 32. The thickness-wise direction of the inner tube 60 coincides with the radial direction.

The stopper 24 is arranged coaxially with the die cavity 22 and fixed by a fixing member (not shown). As shown in FIG. 16A, the stopper 24 includes a distal end that is fitted to the inner tube 60 of the metal material 10 and a step 24*a* that comes into contact with the end surface of the inner tube 60.

The counter punch 40, which is opposed toward the punch 30, has the form of a cylindrical tube. The counter punch 40 is fitted in the groove 63 between the inner tube 60 and the outer tube 62 of the metal material 10 and arranged to contact the bottom portion 64A. An air cylinder or the like (not shown) applies back pressure to the counter punch 40 so that the bottom portion 64A is constantly pressed. The punch 30 corresponds to the first punch, and the counter punch 40 corresponds to the second punch. The counter punch 40 may be omitted.

A precision forging method in accordance with the present embodiment will now be described.

First Step

As shown in FIG. 16A, in a first step, the metal material 10 is arranged in the die cavity 22 of the die 20 of the precision forging device 50, and the stopper 24 is fitted in the inner tube 60 so that the step 24*a* comes into contact with the inner tube 60. In this state, the inner tube 60 is arranged in the die cavity 22 so as to extend in the punch moving direction, and the bottom portion 64A is arranged so as to extend in a direction intersecting the punch moving direction. The punch moving direction coincides with the axial direction of the inner tube 60. Further, the outer circumferential surface of the bottom portion 64A, that is, the outer circumferential surface of the outer tube 62, is in a state in plane contact with the wall surface of the die cavity 22.

The punch 30 is arranged in the die cavity 22 so as to be opposed toward the bottom portion 64A and part of the inner tube 60 thickness-wise. The part of the inner tube 60 thickness-wise that is opposed toward the punch 30 is an outer circumferential region of the inner tube 60 located radially outward from the inner circumferential edge of the cutting blade 32.

Second Step

In a second step, the punch 30 is moved toward the bottom portion 64A to press and cut the inner tube 60 with the cutting blade 32. In this state, the metal material 10 remains held by the stopper 24 in the moving direction of the punch 30. The movement amount of the punch 30 from where the punch 30 initially comes into contact with the bottom portion 64A is in a range that is greater than or equal to the thickness of the bottom portion 64A and less than the height of the inner tube 60.

As the punch 30 presses the bottom portion 64A and cuts part of the inner tube 60 thickness-wise with the cutting blade 32, shear deformation caused by the cutting blade 32 occurs between the joint line A of the bottom portion 64A (64B), which comes into contact with the cutting blade 32 formed on the working end surface of the punch 30, and the joint line B, which is located between the bottom portion 64A (64B) and the outer circumference of the inner tube 60. The reference character 64A denotes the bottom portion prior to working, and the reference character 64B denotes the bottom portion during and subsequent to working. The bottom portion 64A corresponds to a pre-working projecting wall. The bottom portion 64B corresponds to a post-working projecting wall.

The sheared material (chips) cut out by the cutting blade 32 enters the bottom portion 64A between the punch 30 and the counter punch 40 (i.e., node) and forms a metal flow W between the joint line A and the joint line B, which are shown in FIG. 16A.

The surface of the bottom portion 64A (64B) where the joint line B is located corresponds to a first surface, and the surface of the bottom portion 64A(64B) at the side opposite to the first surface corresponds to a second surface. FIG. 16B is a diagram illustrating a state when cutting has ended. As shown in FIG. 16B, the metal flow W extends from the portion in the first surface denoted by reference character "B" to the portion in the second surface denoted by reference character "A."

The bottom portion 64A, 64B is constrained by the die 20 so that the dimensions do not change in a direction intersecting the moving direction of the punch 30, as shown in FIGS. 16A and 16B. Thus, as the working performed by the punch 30 progresses, the material (chips) is compressed and moved toward the node to increase the thickness of the node.

In the same manner as the first embodiment, the back pressure $F_b$ applied to the counter punch 40 is much smaller than the pushing force F of the punch 30, that is, $F_b \ll F$ is satisfied. As the thickness of the node increases as described above, the counter punch 40 moves backward against the urging force (back pressure) applied by the air cylinder or the like (not shown).

As shown in FIG. 16B, as the punch 30 presses the bottom portion 64B and moves, the portion of the inner tube 60 located radially inward from the cutting blade 32 remains unaffected.

As a result, as shown in FIGS. 15C and 15D, in the metal material 10 subsequent to cutting, that is, in the precision forging product, the pre-working bottom portion 64A, which is located at one end of the inner tube 60, is moved toward the other end of the inner tube 60 and becomes the bottom portion 64B. As shown in FIGS. 15B and 15D, the thickness of the post-working bottom portion 64B is greater than the thickness of the pre-working bottom portion 64A, and the inner tube 60 has a post-working thickness $K_1$ that is less than the pre-working thickness $K_0$.

The fourth embodiment has the same advantages as the third embodiment.

Fifth Embodiment

A fifth embodiment will now be described with reference to FIGS. 17A to 17D.

Figure 17C:
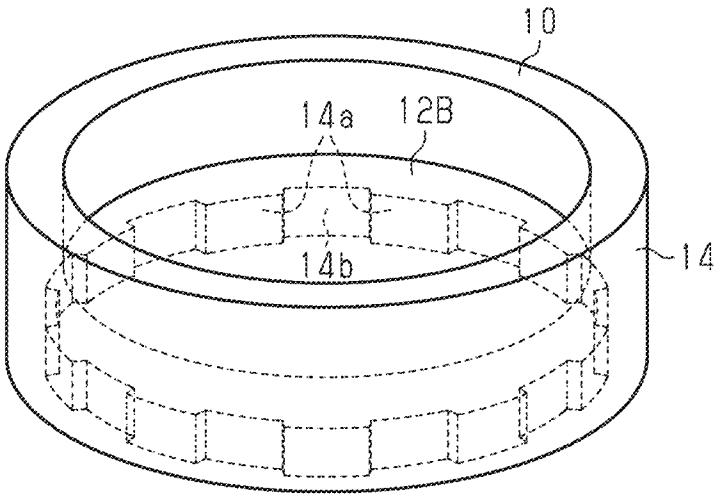
FIG. 17C is a perspective view of a precision forging product subsequent to working.
Figure 17A:
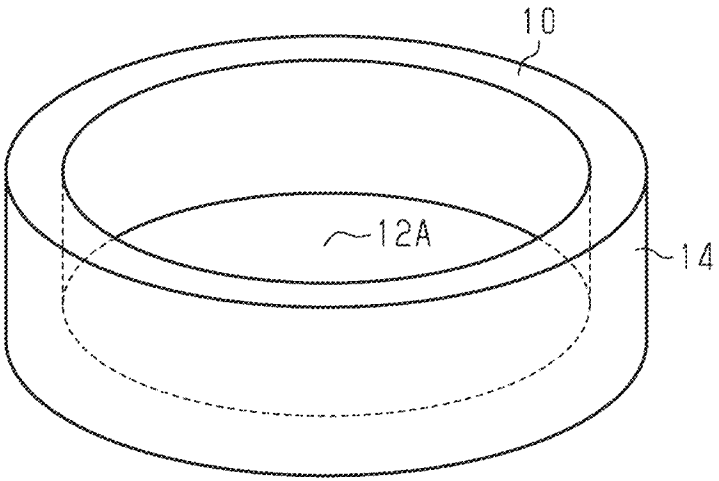
FIG. 17A is a perspective view of a metal material prior to working in accordance with a fifth embodiment.
Figure 17D:
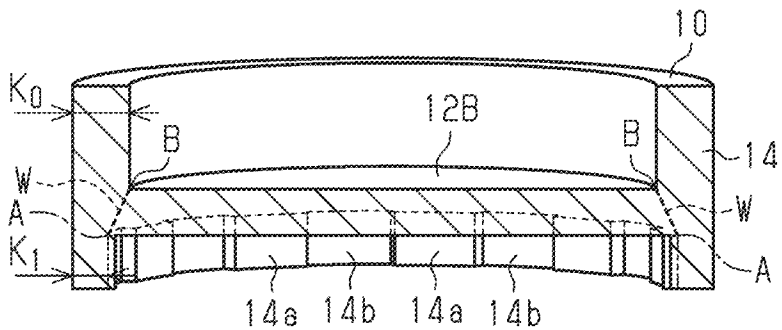
FIG. 17D is a vertical cross-sectional view of the precision forging product subsequent to working.
Figure 17B:
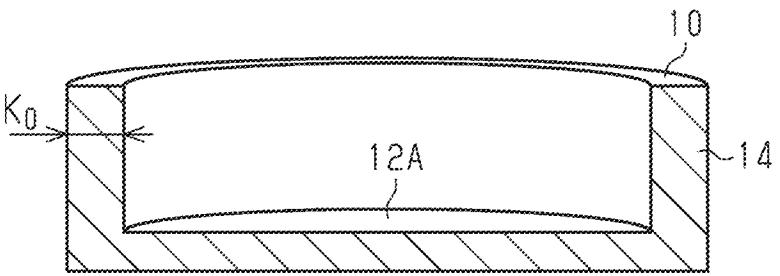
FIG. 17B is a vertical cross-sectional view of the metal material prior to working.

As shown in FIGS. 17A and 17B, the metal material 10 of the present embodiment prior to working includes the circumferential wall 14, which has the form of a cylindrical tube in the same manner as the first embodiment, and the bottom portion 12A, which is coupled integrally with the lower part of the circumferential wall 14.

The precision forging device 50 used in the present embodiment differs from the precision forging device 50 described in the first embodiment in the shape of the cutting blade 32. In the first embodiment, the working end surface 31 of the punch 30 is flat, and the cutting blade 32, which is circular, is formed along the entire circumference of the working end surface 31 in a plan view of the punch 30. In the present embodiment, the working end surface 31 of the punch 30 is flat, and the cutting blade 32 formed along the entire circumference of the working end surface 31 includes recesses and projections that are arranged alternately in the circumferential direction. Except for the cutting blade 32 of the punch 30 of the precision forging device 50, the structure is the same as the first embodiment. The cutting blade 32 does not have to be shaped to include the recesses and projections that are alternately arranged in the circumferential direction and may have any shape.

The precision forging method according to the fifth embodiment is the same as the first embodiment and thus will not be described in detail. The first step is shown in FIG. 1A, and the second step is shown in FIGS. 1B and 1C.

FIG. 17C is a perspective view of the precision forging product subsequent to working, and FIG. 17D is a vertical, cross-sectional view of the precision forging product subsequent to working. As shown in FIGS. 17C and 17D, the worked side of the inner circumferential surface in the circumferential wall 14 of the metal material 10 includes projections 14*a* and recesses 14*b* that are alternately arranged in the circumferential direction because of the cutting blade 32 of the punch 30. As shown in FIG. 17D, the metal flow W is formed between the joint line A and the joint line B.

As shown in FIGS. 17B and 17D, the thickness of the post-working bottom portion 12B is greater than the thickness of the pre-working bottom portion 12A, and the portion of the circumferential wall 14 subject to cutting has a post-working thickness $K_1$ that is less than the pre-working thickness $K_0$.

Sixth Embodiment

A sixth embodiment will now be described with reference to FIGS. 18A to 18D.

Figure 18C:
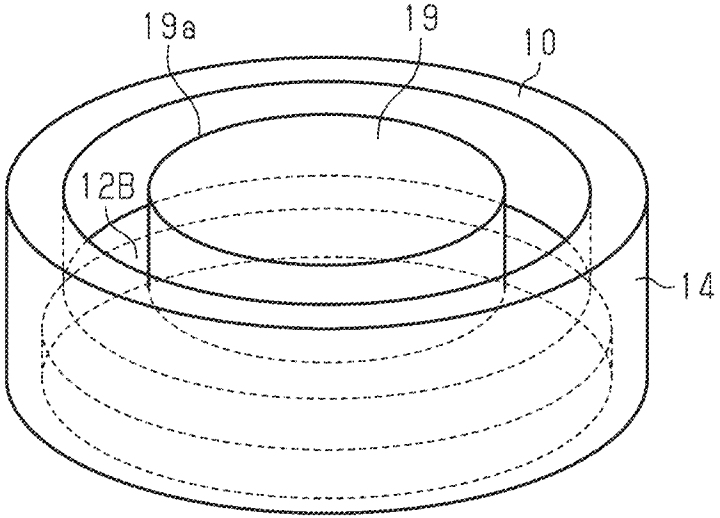
FIG. 18C is a perspective view of a precision forging product subsequent to working.
Figure 18A:
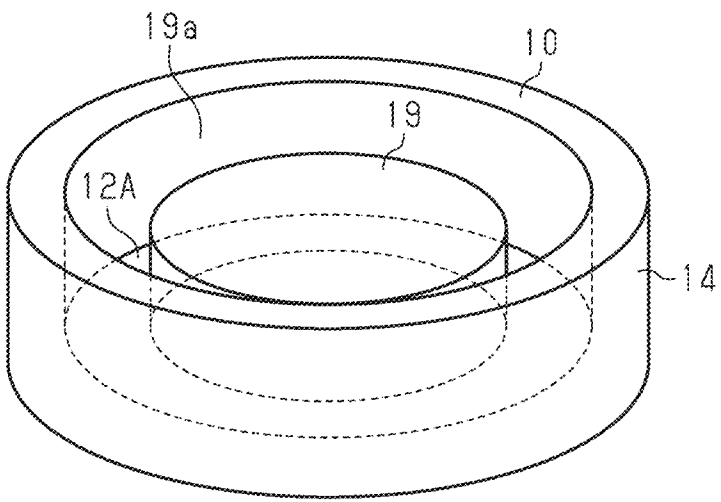
FIG. 18A is a perspective view of a metal material prior to working in accordance with a sixth embodiment.
Figure 18D:
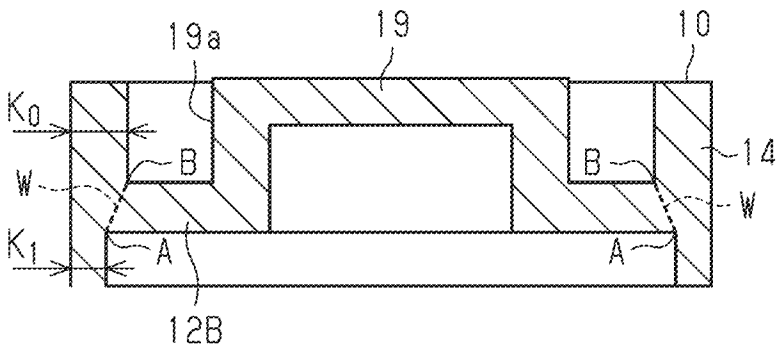
FIG. 18D is a vertical cross-sectional view of the precision forging product subsequent to working.
Figure 18B:
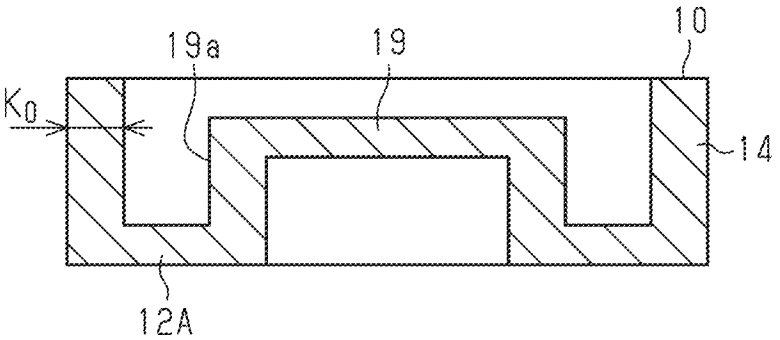
FIG. 18B is a vertical cross-sectional view of the metal material prior to working.

As shown in FIGS. 18A and 18B, the metal material 10 of the present embodiment prior to working includes the circumferential wall 14, which has the form of a cylindrical tube in the same manner as the first embodiment, and the bottom portion 12A, which is coupled integrally with the lower part of the circumferential wall 14.

In the first embodiment, the bottom portion 12A is entirely flat. In the present embodiment, the central region of the bottom portion 12A is projected in the direction in which the circumferential wall 14 extends and defines a projected portion 19 that is a tubular body including a top wall as viewed in FIG. 18B. The projected portion 19 has a circular cross section and is arranged coaxially with the circumferential wall 14. A circular ring-shaped groove 19*a* extends between the projected portion 19 and the circumferential wall 14.

Although not shown in the drawings, the precision forging device 50 used in the present embodiment is similar to the precision forging device 50 described in the first embodiment and thus will not be described below.

The precision forging method according to the sixth embodiment is the same as the first embodiment and thus will not be described below. FIG. 18C is a perspective view of the precision forging product subsequent to working, and FIG. 18D is a vertical, cross-sectional view of the precision forging product subsequent to working.

As shown in FIGS. 18C and 18D, as a result of cutting forging performed by the precision forming device, in the metal material 10 subsequent to cutting, that is, in the precision forging product, the bottom portion 12A, which is located at one end of the circumferential wall 14, is moved toward the other end of the circumferential wall 14 and becomes the bottom portion 12B. As shown in FIGS. 18B and 18D, the thickness of the post-working bottom portion 12B is greater than the thickness of the pre-working bottom portion 12A, and the portion of the circumferential wall 14 subject to cutting has a post-working thickness $K_1$ that is less than the pre-working thickness $K_0$.

The sixth embodiment has the same advantages as the first embodiment.

Seventh Embodiment

A precision forging device and a precision forging product in accordance with a seventh embodiment will now be described with reference to FIGS. 19A to 19B, 20A, and 20B.

Figure 19A:
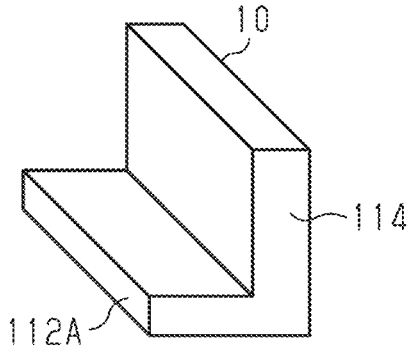
FIG. 19A is a perspective view of a metal material prior to working in accordance with a seventh embodiment.

As shown in FIG. 19A, the metal material 10 has an L-shaped cross section and includes a wall portion 114, which has the form of a quadrangular plate, and a pre-working projecting wall 112A, which has the form of a quadrangular plate and is coupled integrally to the lower part of the wall portion 114. Thus, the pre-working projecting wall 112A extends from the wall portion 114 in an orthogonal direction that is a direction intersecting the height-wise direction of the wall portion 114. The wall portion 114 corresponds to a flat wall portion. The height-wise direction corresponds to the first direction. The orthogonal direction, which is a direction intersecting the height-wise direction, corresponds to the second direction. In the description hereafter, the reference character "112A" denotes the projecting wall prior to working, and the reference character "112B" denotes the projecting wall during and subsequent to working.

The precision forging device 50 used in the present embodiment will now be described.

Figure 20A:
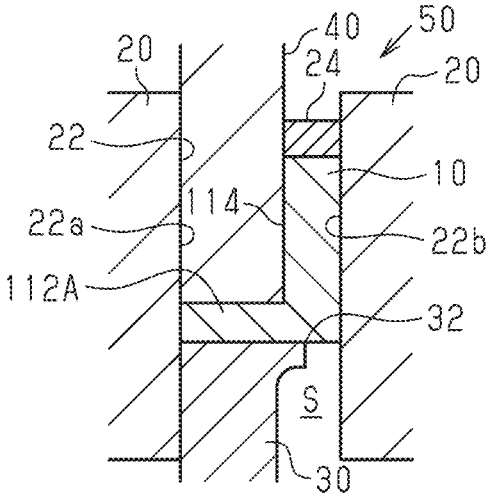
FIGS. 20A and 20B are diagrams illustrating steps of a precision forging method in accordance with the seventh embodiment.
Figure 20B:
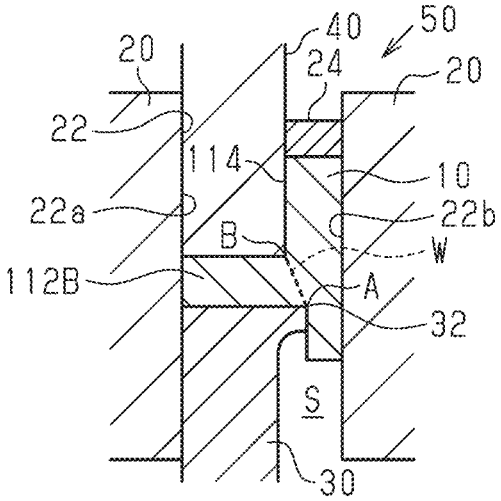

As shown in FIGS. 20A and 20B, the precision forging device 50 includes the die 20, which has the die cavity 22, the punch 30, the stopper 24, and the counter punch 40.

The die cavity 22 has a transverse cross section having rectangular shape, that is, a quadrangular shape, to allow for fitting of the pre-working projecting wall 112A. The die cavity 22 includes two wall surfaces 22*a* and 22*b* that are opposed toward each other and correspond to the long sides of the rectangular transverse cross section. The first wall surface 22*a* is in contact with one side of the punch 32 and one side of the counter punch 40, and the second wall surface 22*b* is spaced apart from the other side of the punch 32 and the other side of the counter punch 40.

The stopper 24 has the form of a polygonal pillar and is fixed to the die 20 in contact with the wall portion 114. The stopper 24 may be an engagement step formed integrally with the die 20.

As shown in FIGS. 20A and 20B, the punch 30 has the form of a plate. The working end surface of the punch 30 is flat, and the cutting blade 32 is formed on the edge of the working end surface opposed toward the second wall surface 22*b* of the die cavity 22. In FIG. 20A, the cutting blade 32 extends in a direction perpendicular to the plane of the drawing. The cutting blade 32 is spaced apart by the gap S from the second wall surface 22*b* of the die cavity 22. The cutting blade 32 is formed to move continuous chips, which are produced w % ben the wall portion 114 of the metal material 10 is cut, toward the wall surface 22*a*.

When the punch 30 moves in the die cavity 22, the portion of the metal material 10 located closer to the wall surface 22*b* than the cutting blade 32 in the gap S between the punch 30 and the second wall surface 22*b* remains unaffected.

The counter punch 40, which is opposed toward the punch 30, is arranged in the open space surrounded by the wall portion 114 of the metal material 10, the pre-working projecting wall 112A, the first wall surface 22*a*, and the like. An air cylinder or the like (not shown) applies back pressure to the counter punch 40 so that the counter punch 40 constantly presses the projecting wall 112A. The counter punch 40 may be omitted.

A precision forging method in accordance with the present embodiment will now be described.

First Step

As shown in FIG. 20A, in a first step, the metal material 10, which includes the pre-working projecting wall 112A and the wall portion 114, is arranged in the die cavity 22 of the die 20 so that the wall portion 114 comes into contact with the stopper 24. In this state, the wall portion 114 is arranged in the die cavity 22 so as to extend in the punch moving direction, and the pre-working projecting wall 112A is arranged so as to extend in a direction intersecting the punch moving direction. The punch moving direction coincides with the height-wise direction of the wall portion 114. Further, the end surface of the pre-working projecting wall 112A is in plane contact with the first wall surface 22*a* of the die cavity 22.

The punch 30 is arranged in the die cavity 22 so as to be opposed toward the pre-working projecting wall 112A and part of the wall portion 114 thickness-wise.

Second Step

In a second step, the punch 30 is moved toward the pre-working projecting wall 112A to press and cut the wall portion 114 with the cutting blade 32. In this state, the metal material 10 remains held by the stopper 24 in the moving direction of the punch 30. The movement amount of the punch 30 from where the punch 30 initially comes into contact with the pre-working projecting wall 112A is in a range that is less than the height of the wall portion 114.

As the punch 30 presses the pre-working projecting wall 112A (112B) and cuts part of the wall portion 114 thickness-wise with the cutting blade 32, shear deformation caused by the cutting blade 32 occurs between the joint line A of the projecting wall 112A (112B), which comes into contact with the cutting blade 32 of the punch 30, and the joint line B, which is located between the projecting wall 112A (112B) and the wall portion 114. In FIG. 20A, the cutting blade 32 extends in a direction perpendicular to the plane of the drawing. Thus, the joint lines A and B of the present embodiment are straight lines.

The sheared material (chips) cut out by the cutting blade 32 enters the projecting wall 112A (112B) (i.e., node) between the punch 30 and the counter punch 40 and forms a metal flow W between the joint line A and the joint line B, as shown in FIG. 20B. The surface of the projecting wall 112A (112B) where the joint line B is located corresponds to a first surface, and the surface of the projecting wall 112A (112B) at the side opposite to the first surface corresponds to a second surface. As shown in FIG. 20B, the metal flow W extends from the portion in the first surface denoted by reference character "B" to the portion of second surface denoted by reference character "A."

The pre-working projecting wall 112A (post-working projecting wall 112B) is constrained by the die 20 so that the dimensions do not change in a direction intersecting the moving direction of the punch 30, as shown in FIGS. 20A and 20B. Thus, as the working performed by the punch 30 progresses, the material (chips) is compressed and moved toward the node to increase the thickness of the node.

In the same manner as the first embodiment, the back pressure Fb applied to the counter punch 40 is much smaller than the pushing force F of the punch 30, that is, Fb<<F is satisfied. As the thickness of the node increases as described above, the counter punch 40 is moved backward against the urging force (back pressure) applied by the air cylinder or the like (not shown).

As a result, as shown in FIGS. 20A and 20B, in the metal material 10 subsequent to cutting, that is, in the precision forging product, the pre-working projecting wall 112A, which is located at one end of the wall portion 114, is moved toward the other end of the wall portion 114, and becomes the projecting wall 112B.

Figure 19B:
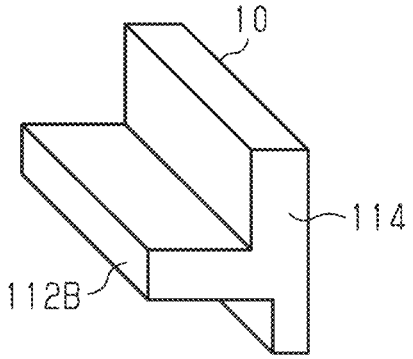
FIG. 19B is a perspective view of a precision forging product subsequent to working.

As shown in FIGS. 19A and 19B, the thickness of the post-working projecting wall 112B is less than the thickness of the pre-working projecting wall 112A.

In the seventh embodiment, the wall portion 114 has the form of a flat plate but may be bent in a transverse cross section that is orthogonal to the first direction. Preferably, in this case, the cutting blade 32 of the punch 30 is shaped in conformance with the bend in the wall portion 114.

Eighth Embodiment

A precision forging device and a precision forging product in accordance with an eighth embodiment will now be described with reference to FIGS. 21A, 21B, 22A, and 22B.

Figure 21A:
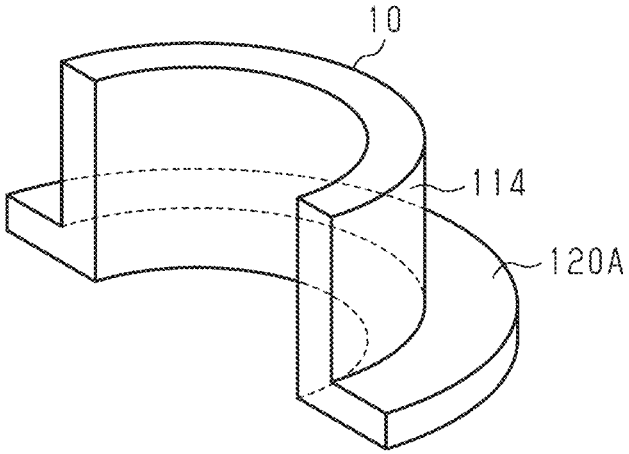
FIG. 21A is a perspective view of a metal material prior to working in accordance with an eighth embodiment.
Figure 21B:
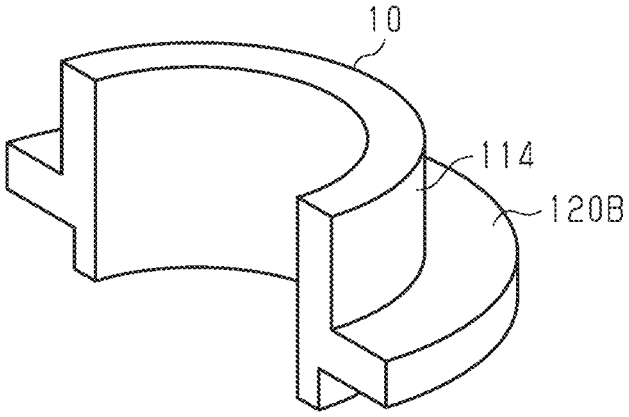
FIG. 21B is a perspective view of a precision forging product subsequent to working in accordance with an eighth embodiment.

As shown in FIG. 21A, the metal material 10 of the present embodiment prior to working includes a semicircular wall portion 114 and a semicircular flange 120A extending radially and coupled integrally to the outer circumferential surface of the basal end of the wall portion 114. Thus, the flange 120A extends in the radial direction from the wall portion 114 in a direction intersecting the height-wise direction of the wall portion 114. The flange 120A corresponds to an outwardly directed flange. The wall portion 114 corresponds to a curved wall portion. The wall portion 114 is semicircular in a transverse cross section but does not have to be semicircular and may be shaped to have a different arcuate shape, such as the shape of the alphabet C, or have a shape defined by a radius of curvature varied in the circumferential direction. In the present embodiment, the height-wise direction of the wall portion 114 corresponds to the first direction. Further, the radial direction corresponds to the second direction.

The precision forging device 50 used in the present embodiment will now be described.

Figure 22A:
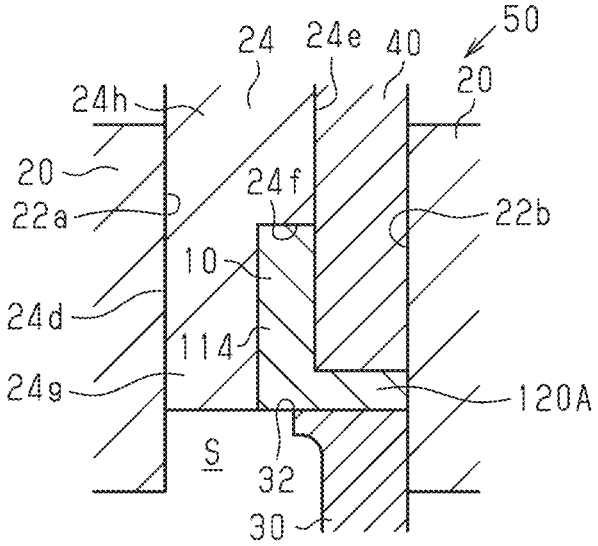
FIGS. 22A and 22B are diagrams illustrating steps of a precision forging method in accordance with the eighth embodiment.
Figure 22B:
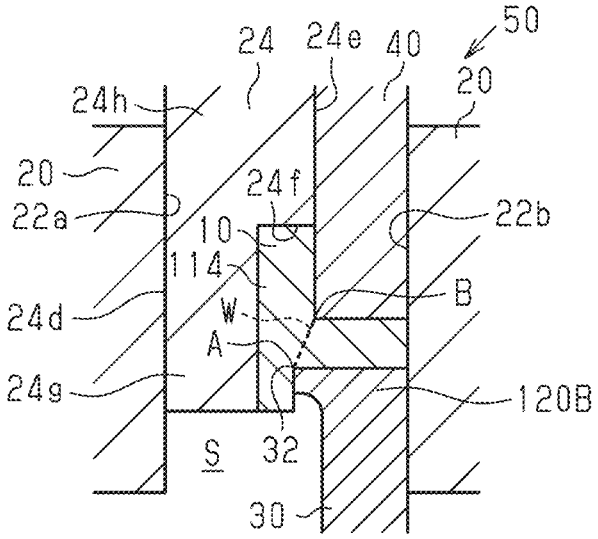

As shown in FIGS. 22A and 22B, the precision forging device 50 includes the die 20, which has the die cavity 22, the punch 30, the stopper 24, and the counter punch 40.

The die cavity 22 includes the first wall surface 22*a*, which is a flat surface, and the second wall surface 22*b*, which is a concave surface, and is shaped to be semicircular in a transverse cross section so as to allow for fitting of the flange 120A. The punch 30 and the cutting blade 32 are semicircular, have a radius of curvature at the outer side that is the same as that of the second wall surface 22*b*, and are in plane contact with and slidable on the second wall surface 22*b*. The working end surface of the punch 30 has a length in the radial direction that is greater than the extending amount of the flange 120A from the wall portion 114 and less than the total of the extending amount of the flange 120A and the thickness of the wall portion 114 in the radial direction. The cutting blade 32 is formed along the entire inner edge of the working end surface of the punch 30.

The counter punch 40 is semicircular, has a radius of curvature at the outer side that is the same as the second wall surface 22*b*, and is in plane contact with and slidable on the second wall surface 22*b*. The inner side of the counter punch 40 has the same radius of curvature as the outer surface of the wall portion 114 and is in plane contact with and slidable on the outer surface. The end surface of the counter punch 40 opposed toward the punch 30 is flat and contacts the flange 120A.

The width of the counter punch 40 in the radial direction is equal to the extending length of the flange 120A from the wall portion 114.

The punch 30 is spaced apart from the first wall surface 22*a*, and the gap S is formed between the cutting blade 32 and the first wall surface 22*a*. The stopper 24 is fixed to the die 20. The stopper 24 includes a side surface 24*d*, which is a flat surface, and a side surface 24*e*, which is a convex surface, and is shaped to be semicircular in a transverse cross section. The stopper 24 includes a main body portion 24*h* and a distal end portion 24*g*. The radius of the side surface 24*e* in the distal end portion 24*g* is smaller than the radius of the side surface 24*e* in the main body portion 24*h*, and an engagement step 24*f* is formed between the main body portion 24*h* and the distal end portion 24*g*.

As shown in FIGS. 22A and 22B, the engagement step 24*f* comes into contact with the wall portion 114. The side surface 24*e* of the main body portion 24*h* of the stopper 24 is in plane contact with and slidable relative to the counter punch 40. Further, the side surface 24*e* of the distal end portion 24*g* of the stopper 24 is in plane contact with the inner surface of the wall portion 114. The side surface 24*d* of the stopper 24 is entirely in plane contact with the first wall surface 22*a*.

The precision forging method in accordance with the present embodiment and its advantages will not be described since they are similar to the precision forming method in accordance with the seventh embodiment and can be understood by interchanging "the pre-working projecting wall 112A" to "the flange 120A", "the projecting wall 112B subsequent to working" to "the flange 120B", "FIG. 20" to "FIG. 22", "FIG. 19" to "FIG. 21", "112A" to "120A", and "112B" to "120B". The flange 120A corresponds to the pre-working projecting wall. Further, the cutting blade 32 of the punch 30 in the present embodiment is semicircular. Thus, the joint lines A and B are semicircular.

Figure 21C:
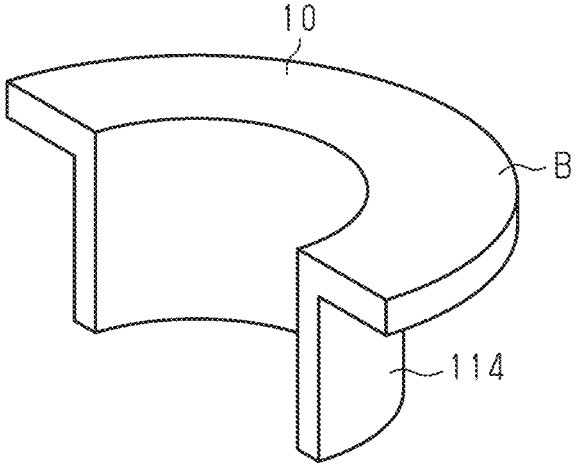
FIG. 21C is a vertical cross-sectional view of a precision forging product subsequent to working in accordance with a ninth embodiment.

In the above description, the post-working flange 120B is located closer to the basal end than the central part of the wall portion 114 in the height-wise direction of the wall portion 114 but may be located at the upper end with respect to the height-wise direction of the wall portion 114, as shown in FIG. 21C.

Further, in the eight embodiment that includes the outwardly directed flange, an inwardly directed flange may be used instead of the outwardly directed flange.

DESCRIPTION OF REFERENCE CHARACTERS

10) metal material, 12A and 12B) bottom portion, 14) circumferential wall, 16) open space, 20) die, 22) die cavity, 24) stopper, 30) punch, 32) cutting blade, 40) counter punch, 50) precision forging device, A and B) joint line, W) metal flow

The invention claimed is:

1. A precision forging method for a metal material, the metal material including a wall portion, which extends in a first direction, and a pre-working projecting wall, which extends from the wall portion in a second direction intersecting the first direction, the precision forging method comprising:

arranging the metal material in a die cavity of a die;

arranging a first punch, which includes a working end surface and a cutting blade formed at an edge of the working end surface, in the die cavity so that the first punch is opposed toward part of the wall portion thickness-wise and the pre-working projecting wall of the metal material;

arranging a second punch at a side of the pre-working projecting wall opposite to the first punch;

moving the first punch in the first direction within a range of a height of the wall portion in a state in which the metal material is held in the first direction and a length of the pre-working projecting wall in the second direction is maintained so that the cutting blade cuts the part of the wall portion thickness-wise located in a moving path of the punch and causes shear deformation in the cut part to move the cut part toward the pre-working projecting wall; and moving the second punch so as to follow movement of the first punch in the first direction.

2. The precision forging method according to claim 1, wherein:

arranging the metal material includes arranging the metal material, which includes a fit region where at least part of the wall portion comes into plane contact with a wall surface of the die cavity and the pre-working projecting wall located at a side opposite to the fit region, in the die cavity;

arranging the first punch includes arranging the cutting blade of the first punch spaced apart from the wall surface of the die cavity by a distance smaller than a thickness of the wall portion; and moving the first punch includes moving the first punch to cut the metal material with the cutting blade so that the fit region remains in the wall portion.

3. The precision forging method according to claim 1, wherein arranging the metal material includes arranging the metal material in the die cavity so that the wall portion is spaced apart from a wall surface of the die cavity and at least part of the pre-working projecting wall comes into plane contact with the wall surface of the die cavity, the cutting blade being formed inward from a side of the plane contact.

4. The precision forging method according to claim 2, wherein the wall portion is a circumferential wall, wherein when an amount of the circumferential wall cut by the first punch is expressed by $t_0$ mm, a length of the punch in the second direction is greater by $2t_0$ mm than an inner diameter of the circumferential wall, wherein the pre-working projecting wall has a thickness $t_{c0}$ that satisfies $0.1\ \text{mm} \le t_{c0} \le 20$ mm, wherein in a joint line between the circumferential wall and the pre-working projecting wall, the joint line located at a side of the pre-working projecting wall opposite to the punch has a radius of curvature expressed by $r_{cp}$ that satisfies $r_{cp}/t_{c0} < 2.0$, and wherein the metal material is worked so that $t_0/t_{c0}$ satisfies $$t_0/t_{c0} \ge 0.052 r_{cp}/t_{c0} + 0.23.$$

5. The precision forging method according to claim 2, wherein the wall portion is a circumferential wall, wherein when an amount of the circumferential wall cut by the first punch is expressed by $t_0$ mm, a length of the punch in the second direction is greater by $2t_0$ mm than an inner diameter of the circumferential wall, wherein the pre-working projecting wall has a thickness $t_{c0}$ that satisfies $0.1\ \text{mm} \le t_{c0} \le 20$ mm, wherein in a joint line between the circumferential wall and the pre-working projecting wall, the joint line located at a side of the pre-working projecting wall opposite to the punch has a radius of curvature expressed by $r_{cp}$, that satisfies $r_{cp}/t_{c0} \ge 2.0$, and wherein the metal material is worked so that $t_0/t_{c0}$ satisfies $$t_0/t_{c0} \ge 3.0 r_{cp}/t_{c0} - 5.7.$$

6. The precision forging method according to claim 1, further comprising:

having a stopper come into contact with a distal end surface of the wall portion to hold the metal material in the first direction of the punch.

7. A precision forging system comprising:

a metal material including a wall portion, which extends in a first direction, and a pre-working projecting wall, which extends from the wall portion in a second direction intersecting the first direction;

a die including a die cavity configured to allow for arrangement of the metal material; and a first punch configured to move in the first direction in the die cavity to forge the metal material; and a second punch that is arranged at a side of the pre-working projecting wall opposite to the first punch and is configured to move so as to follow movement of the first punch in the first direction, wherein the first punch is opposed toward part of the wall portion thickness-wise and the pre-working projecting wall when the metal material is arranged in the die cavity, wherein the first punch includes a working end surface and a cutting blade, which is formed on an edge of the working edge surface, and wherein when the first punch is moved in the first direction within a range of a height of the wall portion, the cutting blade is configured to cut part of the wall portion thickness-wise in a moving path of the punch and cause shear deformation in the cut part.

8. The precision forging device according to claim 7, further comprising:

a stopper configured to come into contact with a distal end surface of the wall portion when the first punch moves, thereby holding the metal material in the moving direction of the punch.

* * * * *